US009902146B2

(12) United States Patent
Gartner et al.

(10) Patent No.: US 9,902,146 B2
(45) Date of Patent: Feb. 27, 2018

(54) SYSTEM AND METHOD FOR ALIGNING, MOUNTING AND RECORDING ALIGNMENT OF A MOUNTED PRINTING PLATE

(71) Applicant: Gerald J. Gartner and Teresa Ann Gartner, or their successors, as Trustees of the Gerald J. Gartner Revocable Trust u/d/t 6/19/95, as amended, Hollis, NH (US)

(72) Inventors: Gerald J. Gartner, Hollis, NH (US); Joseph Gartner, Boulder, CO (US)

(73) Assignee: Gerald J. Gartner and Teresa Ann Gartner, or their successors, Hollis, NH (US), as Trustees of the Gerald J. Gartner Revocable Trust u/d/t ( * ) Notice: Subject to any disclaimer, the term of this patent is extended or adjusted under 35 U.S.C. 154(b) by 436 days.

(21) Appl. No.: 14/167,621

(22) Filed: Jan. 29, 2014

(65) Prior Publication Data

US 2014/0326152 A1 Nov. 6, 2014

Related U.S. Application Data

(60) Provisional application No. 61/757,944, filed on Jan. 29, 2013.

(51) Int. Cl.
*B41F 27/00* (2006.01)
*B41F 27/12* (2006.01)
(Continued)

(52) U.S. Cl.
CPC ..... *B41F 27/1268* (2013.01); *B41F 27/005* (2013.01); *B41F 27/06* (2013.01);
(Continued)

(58) Field of Classification Search
CPC ..... B41F 13/12; B41F 27/00; B41F 27/005; B41F 27/06; B41F 27/08; B41F 27/12;
(Continued)

(56) References Cited

U.S. PATENT DOCUMENTS 4,380,956 A * 4/1983 Elworthy ..... B41F 27/005 101/383
4,611,539 A * 9/1986 Ireton ..... B41F 27/005 101/401.1
4,727,806 A * 3/1988 Green, Sr. ..... B41F 27/005 101/415.1
4,846,063 A * 7/1989 Brown ..... B41F 27/005 101/415.1
(Continued)

FOREIGN PATENT DOCUMENTS

GB 2083411 * 9/1981 ..... B41F 27/00

*Primary Examiner* — Jill Culler
*Assistant Examiner* — Marissa Ferguson Samreth

(57) ABSTRACT

A system and method for aligning a generally flat, planar object and for facilitating the mounting of the generally flat planar object, such as a printing plate, in near perfect alignment in a cylindrical manner. A printing plate cylinder is covered with stickyback having a release liner. A narrow axial strip of release liner is removed and replaced with a piece of release liner that may be pulled or tugged from beyond the end of the printing cylinder. The printing plate is next rolled into a cylindrical form and held in place on a device which allows registration marks on the printing plate to align the two ends of the printing plate prior to the printing plate ends being temporarily adhered to one another using a piece of tape or similar product. The aligned printing plate is next slid over the printing cylinder which is covered with sticky back. The piece of release liner covering the section of previously removed stickyback is removed and a portion of the aligned printing plate is adhered to the stickyback at that point. The piece of tape holding the two ends of the printing plate in alignment is now removed along with the remainder of the release liner on the stickyback of the printing cylinder and the remainder of the printing plate is attached to the printing cylinder, providing an aligned print-
(Continued)

ing plate on a printing plate cylinder. A machine vision system is used to record and certify the alignment and can also be used to aid in the alignment process based on prior aligned plates or a reference target alignment position.

18 Claims, 25 Drawing Sheets

(51) Int. Cl.
*B41F 27/08* (2006.01)
*B41F 27/06* (2006.01)

(52) U.S. Cl.
CPC ..... *B41F 27/08* (2013.01); *B41F 27/1206* (2013.01); *B41F 27/1275* (2013.01)

(58) Field of Classification Search
CPC .... B41F 27/1206; B41F 27/1275; B41F 5/24; B41F 27/1268
See application file for complete search history.

(56) References Cited

U.S. PATENT DOCUMENTS 4,925,506 A * 5/1990 Baker ..... B41F 27/1275 101/415.1
5,488,781 A * 2/1996 Van Der Horst ..... B41F 27/005 33/286
5,511,479 A * 4/1996 Rogovein ..... G03F 9/00 101/401.1
5,626,076 A * 5/1997 Ireton ..... B41F 27/005 101/401.1
6,450,092 B2 * 9/2002 Kamir ..... B41N 6/02 101/170
7,819,060 B2 * 10/2010 Taylor ..... B41F 27/005 101/375
7,971,530 B2 7/2011 Otten
2014/0230677 A1 * 8/2014 Sanger ..... B41F 27/005 101/486
2015/0231876 A1 * 8/2015 Kasper ..... B41F 27/005 101/481

* cited by examiner 15
46
21
16
DETAIL C 28
10
30
31
28
DETAIL D

C
22
D
20
B
24
26
27
29
44
10
DETAIL B

SYSTEM AND METHOD FOR ALIGNING, MOUNTING AND RECORDING ALIGNMENT OF A MOUNTED PRINTING PLATE

TECHNICAL FIELD

The present invention relates, in one embodiment, to the printing industry and more specifically, relates to a method for mounting a printing plate in a generally circular manner in near perfect alignment more easily and inexpensively then current methods, thereby providing near perfect alignment of the resultant printed image. Additionally, the present invention relates to the method, equipment and analytical algorithms used to measure, record, control and report the accuracy of printing plate mounting and alignment for a single plate, and for a set of multiple plates used together for a printing job and to indicate acceptability or suggest corrective actions.

BACKGROUND INFORMATION

The printing industry now nearly exclusively utilizes photographic or digitally imaged printing plates to produce a printed image. Although this invention is primarily aimed at flexographic printing, it could be used for letterpress and offset printing, rotary screen printing as well as in any operation where it is desirable to wrap a flat planar item around a concave or convex (oval, a round, etc.) object or more often a cylinder or to form a flat planar item into a circular or tubular shape. In some instances, these "printing plates" are utilized only one time due to wear, storage concerns, economics, or obsolescence after first use, while in other instances, the printing plates will be re-used and are therefore saved.

Many printing presses utilize a circular drum (commonly called the "plate cylinder" or "print(ing) cylinder") on which a printing plate containing typically an etched "raised" or "reverse" image to be printed is mounted. By rotating the plate cylinder and printing plate assembly first in contact with ink and next in contact with the substrate to be printed (paper, plastic, foil, etc.), the inked image is transferred from the plate to the paper. In the offset lithography process, a transfer drum called the "blanket" is between the printing plate and the printed substrate. Printing presses often have multiple printing units or "stations" such that the substrate, web or sheet, passes from one unit to the next. Other converting operations such as die cutting, slitting, laminating, or embossing may precede or follow the printing units, or be inserted between the printing units, or be in separate machines or multiple passes through the same machine. The web or sheets may be processed multiple times in the same or separate machines.

When printing a one color product, proper alignment of the printing plate on the plate cylinder is important to maintain proper orientation to the substrate and possibly to other converting operations. When printing in multiple colors, the printing press must normally have one plate cylinder and printing plate assembly for each color to be printed. In such cases, proper alignment ("registration") of the printing plates on the plate cylinders is essential, otherwise the finished product will have improperly aligned images and colors in addition to improper alignment to the substrate and other converting operations.

In flexographic printing, the imaged printing plate is usually attached to an expensive plate cylinder using "flexographic mounting tape" or "stickyback". Each plate cylinder for a 16-inch "narrow web" press typically costs several hundreds of dollars while plate cylinders for "wide web" presses cost substantially more. Flexographic mounting tape has either a solid core or foam core (usually rubber or polymer) with adhesive applied to both sides. If a plate is to be used in a subsequent run of the same or similar product, it may be desirable to keep it mounted on the plate cylinder.

Since keeping a printing plate mounted on a plate cylinder would tie up that expensive plate cylinder making it not available for other jobs, an alternative has been employed where the plate is mounted on an intermediate shell or sleeve that slides on and off the plate cylinder. These sleeves are usually metal or some plastic or composite material. While less costly than plate cylinders, sleeves are still quite expensive. Many printers have cited the benefits of sleeve mounting, but do not use it because a high investment in a large inventory of blank sleeves matched in diameter to the various diameters of plate cylinders in stock must be maintained to accommodate new jobs as they are scheduled. In addition, storage space required by mounted or blank sleeves is greater than for flat un-mounted printing plates.

The alignment accuracy of plate mounting is critical to produce high quality printing and to minimize waste due to mis-alignment or "mis-register" caused when trying to fit two or more images on top of each other in exact alignment, or when trying to achieve alignment with another operation such as die cutting or embossing. Mis-registration leads to increased manufacturing cost. Substrate and ink are usually large expenses to printing companies and they constantly try to minimize their waste. Lower waste also means shorter production time and thus reduced labor and overhead costs. Often only a specific limited quantity of substrate is available or allocated to produce the required quantity of printed product. Increased waste usually reduces the final quantity of product produced thus reducing the amount of finished product that may be billed for. Since customers usually have a tolerance on the quantity ordered, such as plus or minus 5%, reduction in production quantities could mean a missed sales opportunity. In some cases, if waste is too high, it may be required to purchase additional substrate and re-run a job to produce within the acceptable quantity range.

The major reasons for the need for accurate plate mounting (sleeve or the current system) include, but are not limited to: (1) some minor print mis-registration may be acceptable and in-specification, say +/−0.003 inch. However, out-of-specification production (waste) percentage increases with the amount of plate mis-alignment because of press registration float (relative movement or drift of the printed image locations in different printing units, either or both in the left-to-right or in the front-to-back directions), even on machines equipped with automatic tension, web guiding and automatic registration equipment. This is caused by: variation in substrate parameters; minor inaccuracies in machine drives, gears, cylinders, etc.; environmental conditions such as temperature and humidity; and other causes. Given this situation it is therefore highly desirable that printing plates be mounted as accurately as possible giving maximum registration latitude to other elements of the process.

A second reason for the need for accurate plate mounting arises if the press operator is dissatisfied with the plate mounting accuracy. Material waste and time accumulate as the operator first attempts to bring the job into acceptable running register. He or she may stop the setup or running processes and call for a re-mounting. Thus, the press, which may cost several hundred thousand dollars for narrow web to several million dollars for wide web and has a high hourly standby cost, is idle and not producing. Thirdly, print quality often suffers as more marginally out-of-register work is accepted and shipped. Finally, operators when challenged with plates marginally mis-aligned will need to focus more on the registration element of the process and subsequently run the machine slower and focus less on other elements of the process, resulting in lowered quality, slower running speeds and operator frustration. All these factors contribute to reduced productivity and increased cost.

A number of plate mounting systems are commercially available to mount plates directly on the cylinders or onto the sleeves. These systems generally utilize a method of alignment of two points on the surface of the plate, making the assumption that if all multiple images are in registration relative to two points, the entire composite multi-color (or multi-plate) image will be in registration. Usually registration marks are located such that a line drawn thru them should be perpendicular to the direction that the web or sheet moves thru the press. Most plate mounters are based on alignment of these marks parallel with the axis of the plate cylinder. The systems generally use CCD cameras or microscopes to facilitate this alignment, sometimes in conjunction with a hairline parallel to the plate cylinder axis. Some systems employ attachment points (holes or protrusions) that can be mechanically aligned. The same systems are used to mount plates onto plate cylinders or onto sleeves, so the use of sleeves this way in and of itself does not improve the registration accuracy.

These systems have served the industry well, but they have some limitations. First, not all cylinders are exactly of the same diameter. Also, sometimes cylinders have "taper" meaning that the diameter/circumference is not uniform along its length. Diametric differences also can be introduced either by variations in the mounting tape or its application to the plate cylinder. Also, there is no way to assure that the individual who mounts the plates uses uniform pressure or tension on the plate, which can introduce variability. Such inaccuracies are too small to be seen by an operator without the aid of magnification, yet may cause an out-of-specification condition or reduce registration latitude.

Therefore, even if one end or the central region of the plates is properly aligned, there is no guarantee that the forward or following portions are registered (aligned). One method for providing near perfect alignment of a generally flat planar object such as a printing plate onto a cylinder for mounting on to a printing machine cylinder is disclosed in applicant's U.S. Pat. No. 7,628,110. Although the system and method disclosed in this patent provides significant advantages over the prior art, in some instances two drawbacks with this system and method exist. First, all of the plate cylinders which are going to be utilized with this method must be taken out of service and modified to include a hollow interior region and a number of holes which extend to the exterior cylinder wall surface in order to allow for the use of compressed air to "float" the circular plate and sleeve assembly as it is slid onto the plate cylinder. Alternatively, new plate cylinders could be purchased incorporating these features which are more expensive than conventional cylinders. Cylinders so modified may not then be usable for the standard prior art mounting methodology. Secondly, sleeves which are preformed into a cylindrical form require a storage methodology that takes more space than flat printing plates. Moreover, this method is not familiar to many in the industry and the barrier to entry and acceptance by those in the industry could be difficult to overcome.

The rotary screen process utilizes a screen formed into a tube with the screen ink and squeegee located within the tube. Typically the screen material is a metal or fabric mesh, which is coated with a photosensitive resist such as "Screeny" made by Gallus. It is exposed, etched or ablated in the flat and then wrapped into a tube with a small portion of overlap at the leading and trailing ends. The alignment at this stage is critical so that the images can be printed in register. The overlap is then bonded, usually by some sort of adhesive.

Accordingly, what is needed is a new system and method for forming a printing plate mounted on a printing cylinder which is within the skill of those workers in the industry and somewhat familiar to them, and is both highly accurate and inexpensive and a system, method and analytical algorithms for measuring, recording, controlling and reporting the accuracy of printing plate mounting and alignment for a single plate, and for a set of multiple plates used together for a printing job and to indicate acceptability or suggest corrective actions.

BRIEF DESCRIPTION OF THE DRAWINGS

These and other features and advantages of the present invention will be better understood by reading the following detailed description, taken together with the drawings wherein:

FIG. 7A is a detailed enlarged view of corner region "A" of FIG. 7 showing a registration mark;

FIG. 7B is an enlarged view of a corner region of "B" of FIG. 7 showing a registration mark, reverse graphics and a machine-readable code;

DETAILED DESCRIPTION OF THE PREFERRED EMBODIMENTS

The present invention features, in a first embodiment, a novel system and method for accurately first aligning and then subsequently attaching a photographically or digitally generated printing plate or other generally flat, planar object onto a drum or cylinder, such as a printing plate cylinder of a printing press. An additional feature of the present invention includes, in another embodiment, a system and method for measuring, recording, controlling and reporting on the accuracy of printing plate mounting and alignment for a single plate, and for a set of multiple plates used together for a printing job and to indicate acceptability of the alignment process and/or suggest corrective actions. Although the present invention will be explained in connection with the flexographic method of printing and the alignment of printing plates and mounting printing plates onto a printing press cylinder, this is not a limitation of the present invention as the present invention is equally usable in any situation, method or process wherein the "ends" of a generally flat planar object are rolled into or around a generally cylindrical shape and alignment of the "ends" of the flat planar object vis-a-vis one another planar object or virtual reference is a concern.

Flexography is a method of direct rotary printing using resilient raised image printing plates, affixed to variable repeat plate cylinders, inked by a roll or doctor-blade wiped engraved metal roll, carrying fluid or paste-type inks to virtually any substrate.[1] Although the present invention will be explained and/or illustrated with regards to raised image printing plates, this is not a limitation of the present invention as other types of products, methods, processes or, for example, printing plates containing "reverse" images are contemplated and considered to be within the scope of the present invention. A "raised" or "relief" printing process means that the image portion of the plate is raised above the "floor" of the plate (such as in a rubber stamp for example). The "letterpress" method is also a relief printing process whereas offset lithography plates are essentially planar and rely on the chemistry of the printing area. The present invention applies equally well to all the above referenced printing technologies, printing technologies not referenced, and to other areas of technology unrelated to printing.

[1] *Flexography—Principles and Practices*, Fourth Edition, 1991, Flexographic Technical Association, Inc.

Figure 7:
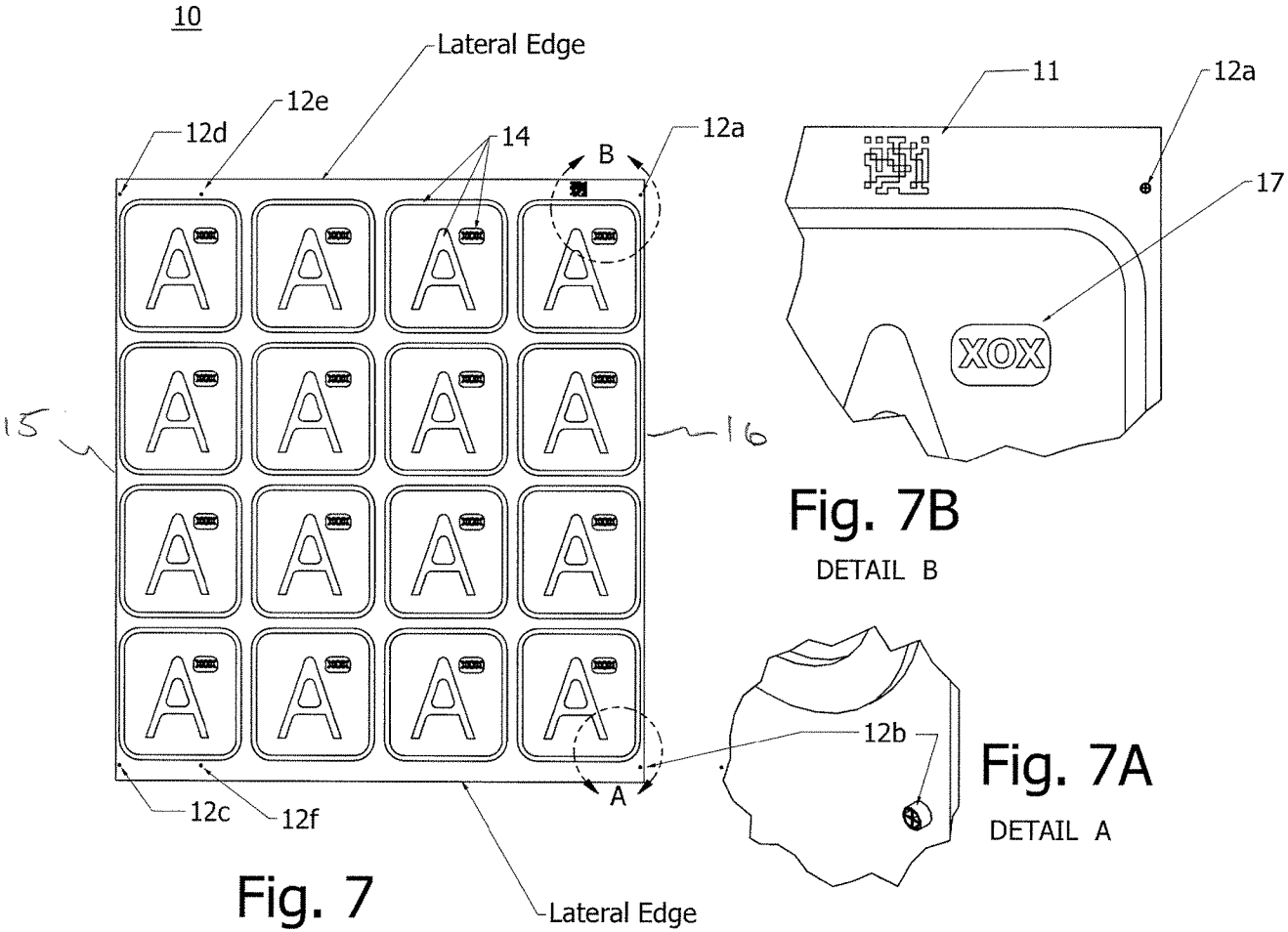
FIG. 7 is a top plan view of a printing plate having imaged thereon indicia and several registration marks according to the present invention.

The invention assumes that a printing plate 10, FIG. 7, will have imaged or otherwise placed thereon two or more and preferably four (4) or more stand-alone registration marks 12 in addition to the graphics and indicia 14 (letters, numerals, symbols and/or images; either positive or reverse 17 printed) to be printed. Multiples of the same or different graphics and indicia may be incorporated onto a single plate, such as shown in FIG. 7 which illustrates 16 identical images. Although the registration marks 12 are shown as separate and distinct registration marks, the invention contemplates that some or all of the registration marks 12 may form or be part of the graphics or indicia itself (such as one or more "dots" on a letter "i") that could be utilized as registration marks.

The alignment or registration marks 12 may be two-dimensional marks imaged on the surface of the printing plate or other generally flat, planar object to be aligned. The two-dimensional marks may include a specific design, such as a dot, cross hair mark or the like, to aid alignment. The alignment or registration marks 12 may also include three-dimensional marks protruding from the generally flat planar surface of the object to be aligned as shown in FIG. 7A. The tops of these protrusions may also include an alignment aid such as a dot, crosshair mark or the like. The registration marks 12 ensure that the printing plate can be mounted in a circular manner with proper alignment between the marks to prevent image misalignment and image skew. Although two marks are contemplated as a minimum, there are preferably provided four or more registration marks.

In one embodiment, printing plate alignment is performed using machine vision equipment utilizing, for example, circular dot registration marks of approximately 0.062-inch diameter. Machine vision (MV) is the technology and methods used to provide imaging-based automatic inspection and analysis for such applications as automatic inspection, process control, and robot guidance in industry. Machine visions systems typically include vision software, vision cameras and/or vision sensors and surface inspection systems used in manufacturing automation and/or quality control for manufacturing operations. The vision camera(s) and software identifies the outside diameter (OD) of the registration mark 12 and calculates its center from which measurements are made. In one embodiment, a small hole in the center of the dot is provided to give an exact center for visual measurements. The registration marks are currently part of the printing surface and show up on the printed substrate unless they are cut off by the operator, which would render the plate unusable for future remounting once the printing plate is removed from the plate cylinder after use.

In addition to the registration marks 12, and the graphics and indicia 14, the printing plate 10 may also include plate identification information or a symbol, such as barcode, QR code or the like shown as 11 in FIG. 7B, used to reference information from another source, such as a database. The plate identification information represented by the QR or similar code 11 may indicate a plate number, job number, or any other type of identifying information or indicia which may be manually read or be utilized by the machine vision system and a production control system to insure that the printing plate is in fact correct for the job and which also allows the machine vision system to store printing plate alignment information associated with the identification information thus documenting or certifying that a particular plate was appropriately aligned. It may also record tracking information such as operator, time of action, approvals, etc. It may also be used to provide necessary data and parameters to the plate mounting machinery. The plate identification information or a symbol 11 may be part of the plate indicia or imaged on the plate by some other means such as ink jet or laser etching.

Figure 1:
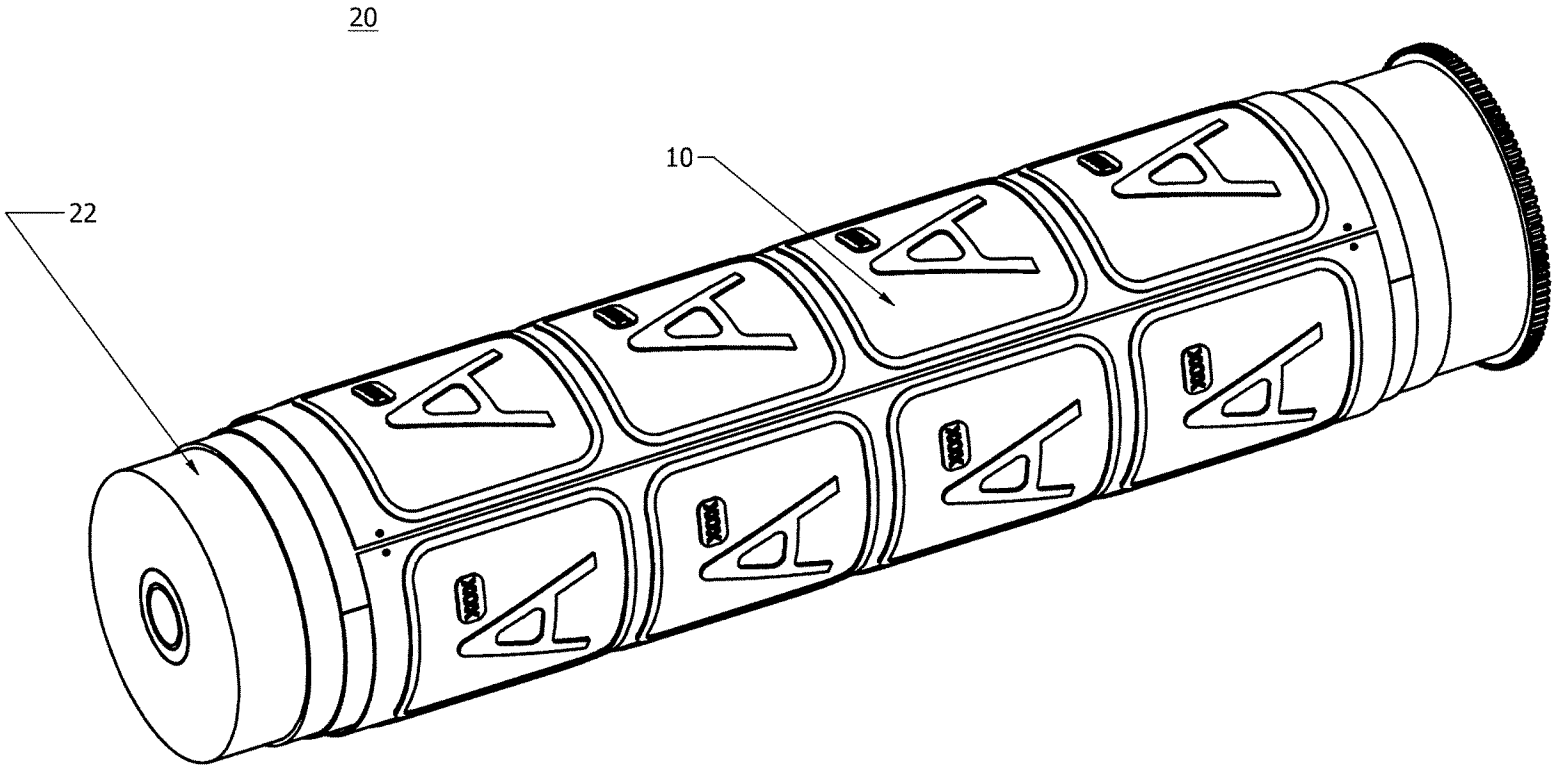
FIG. 1 is in an orthographic view of an aligned and mounted printing plate mounted on a printing plate cylinder.
Figure 2:
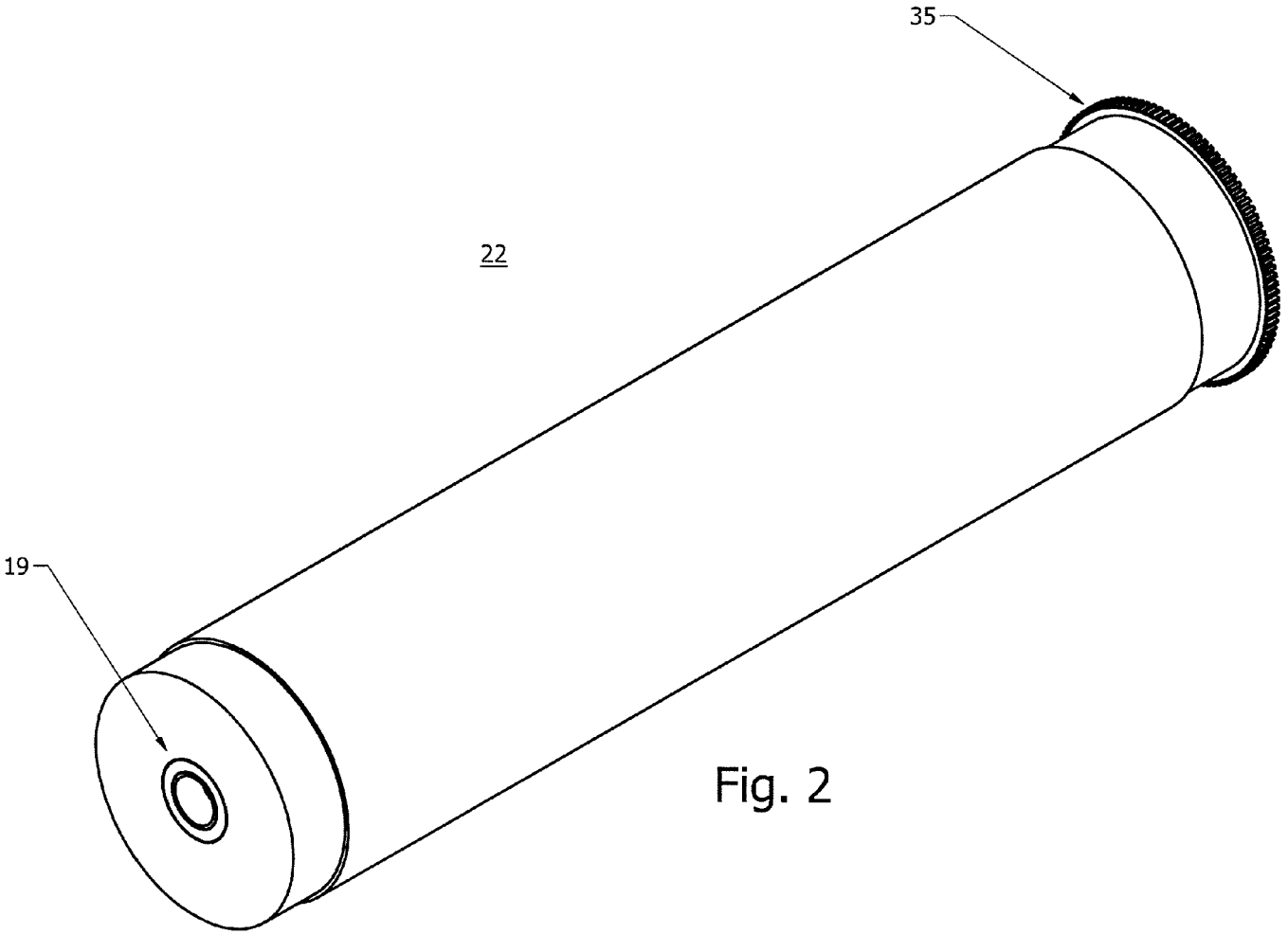
FIG. 2 is an orthographic view of a printing plate cylinder on which is to be mounted an aligned printing plate in accordance with the teachings of the present invention.

The system and method of the present invention produces a printing plate cylinder assembly 20, FIG. 1. The cylinder assembly 20 includes a printing plate 10 and a solid or hollow printing plate cylinder 22 which is adapted for mounting into a printing machine as is well known in the industry. For example, a representative printing plate cylinder 22, FIG. 2 consists of a cylinder with bearings 19 and a drive gear 35. Printing plate cylinders are generally selected corresponding to the layout of the graphics. Important plate cylinder specifications include the accuracy of the cylinder diameter, its taper and total indicated run out (TIR).

Figure 3:
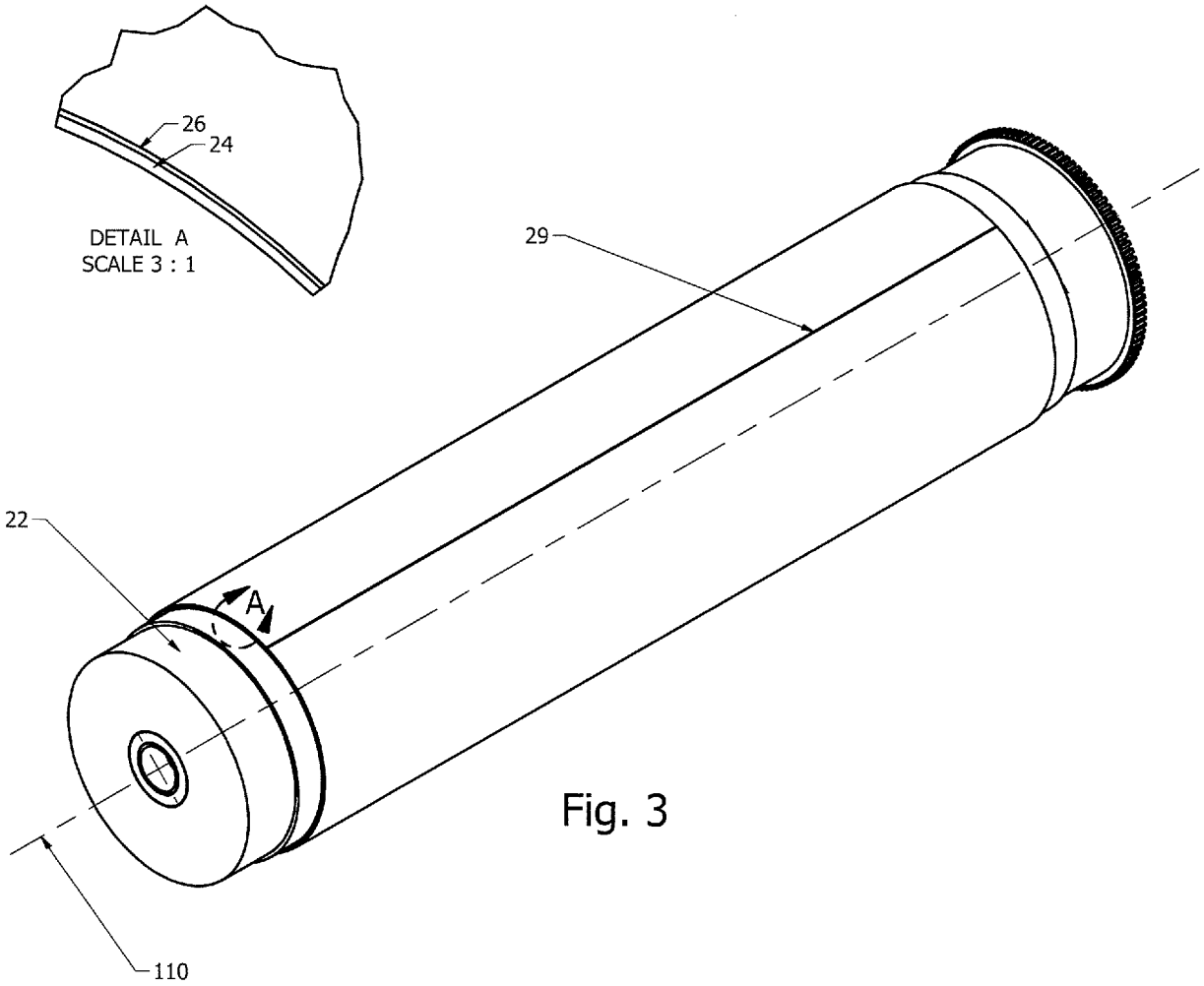
FIG. 3 is an orthographic view of the printing plate cylinder of FIG. 2 on which has been applied mounting tape.

As in the prior art, the printing plate cylinder 22, FIG. 3, is covered (wrapped) essentially completely on its exterior surface with a mounting tape 24 (also called "stickyback") which is supplied in a roll covered by a release liner 26 comprised of release coated paper, plastic or the like. The adhesive is on both sides of the mounting tape 24. Release liner 26 is usually silicone coated on both sides such that it is easily removed from the adhesive surfaces of the mounting tape 24, and to prevent successive wraps from sticking together in the supplied roll.

Figure 21:
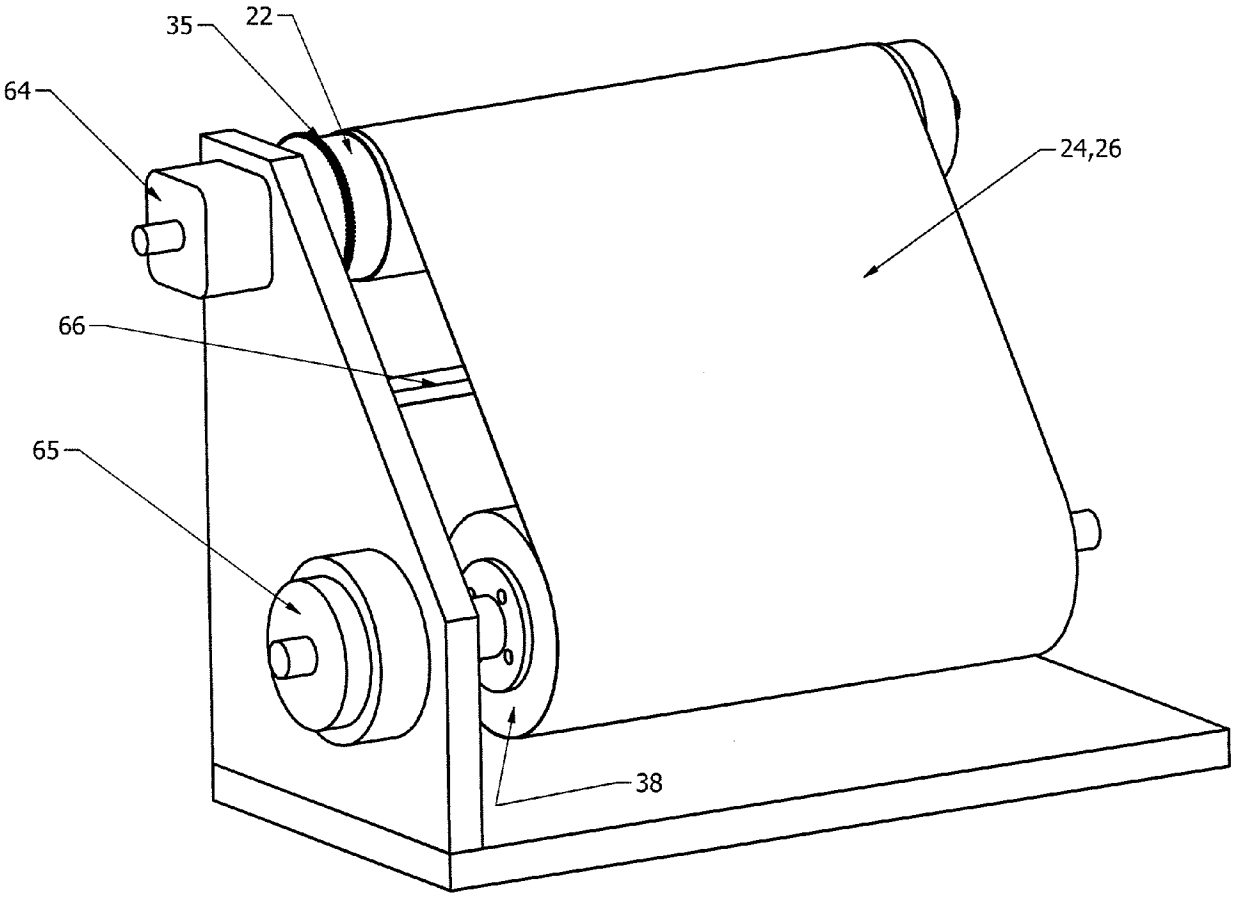
FIG. 21 is an orthographic view of an exemplary device for holding a roll of plate adhesive material and for applying the mounting tape with release liner to a printing cylinder with controlled tension and controlled alignment.

The mounting tape 24 with release liner 26 is typically dispensed from a roll 38, FIG. 21 as supplied, and wrapped around the printing plate cylinder 22 and cut to size; or, un-wound from the supplied roll 38 and cut into a rectangular sheet close to the final desired dimensions. Various techniques are used to apply the mounting tape 24 with release liner 26 onto the plate cylinder surface. In the method of this invention, the mounting tape 24 with liner 26 is applied with controlled tension and controlled alignment to assure that it is smooth and without wrinkles or creases, and that any compression is controlled and preferably uniform for all plate cylinders.

A device such as shown in FIG. 21 could be used. The mounting tape 24 with release liner 26 is unwound from a roll 38 onto the plate cylinder 22 powered by a motor 64 with tension controlled by an unwind tension control device 65, such as a brake, servo motor or torque motor either open loop or closed loop based on a set point and tension measured by a tension sensor 66. The leading and trailing ends of the mounting tape are trimmed such that there is no overlap of the mounting tape and that typically the gap between the leading and trailing ends is small. A straight edge and sharp blade may be used to create a neat narrow gap.

Figure 4:
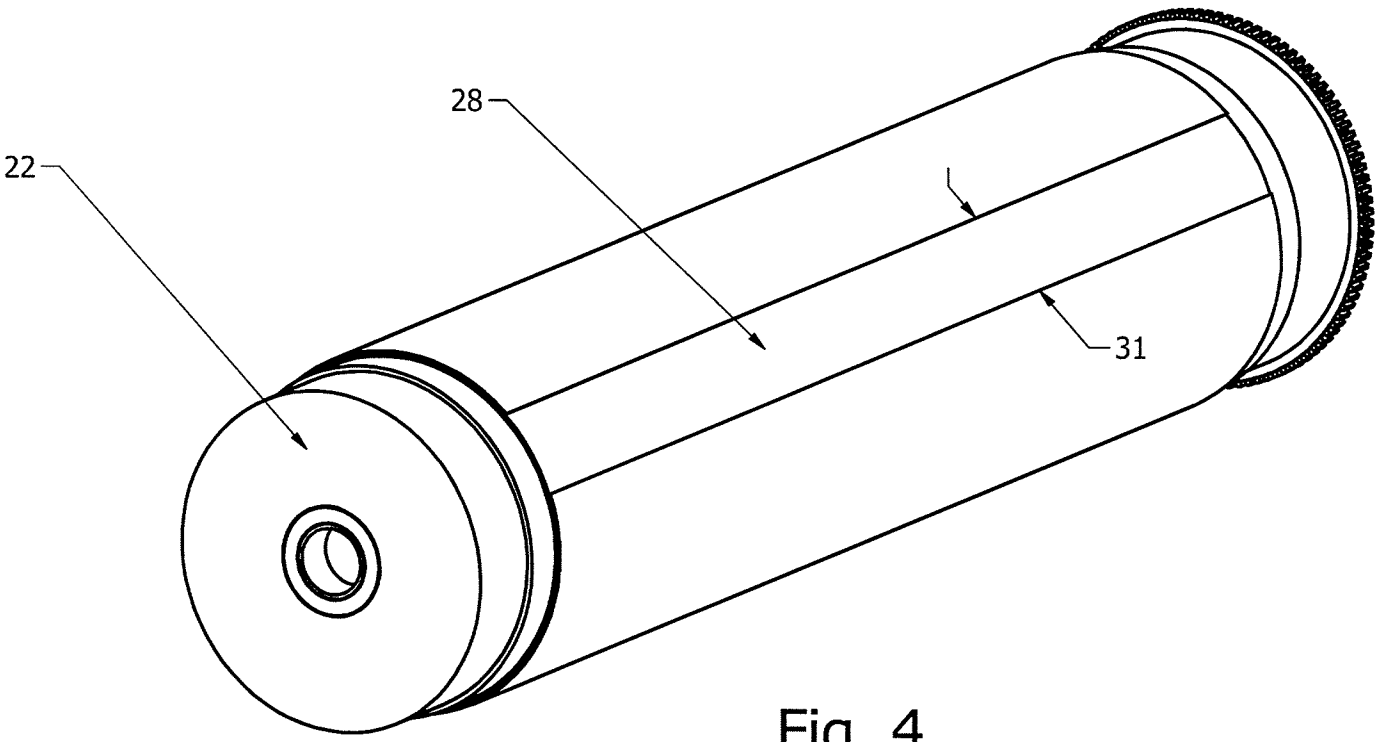
FIG. 4 is an orthographic view of the printing plate cylinder with applied mounting tape of FIG. 3 in which a section of mounting tape liner has been removed to expose the underlying adhesive.

According to the method of this invention, a section 28 of the mounting tape release liner 26 having a width indicated generally by arrow 31 is removed as shown in FIG. 4, exposing adhesive in this area. A typical width 31 of the removed section 28 of release liner 26 is approximately 1 inch although this is not a limitation of the present invention as a width more or less than 1 inch is contemplated and within the scope of the present invention. The removal of section 28 of a portion or width of the mounting tape release liner 26 preferably occurs other than in the area of the gap 29 shown on FIG. 3 between the leading and trailing ends 27, 44 of the mounting tape 24, although this is not a limitation of the present invention as the removal of section 28 shown on FIG. 4 may occur anywhere around the circumference of the printing plate cylinder 22.

In the illustrative example shown in FIG. 4, the mounting tape release liner 26 is in one piece although it is contemplated that it may be desirable for the remaining mounting tape release liner 26 to be in two or more pieces to make its ultimate removal easier and to facilitate subsequent plate attachment. A straight edge and cutting blade may be used to make a cut in the release liner 26 at any other location or locations around the circumference of plate cylinder 22 covered with mounting tape 24 and release liner 26.

Figure 5:
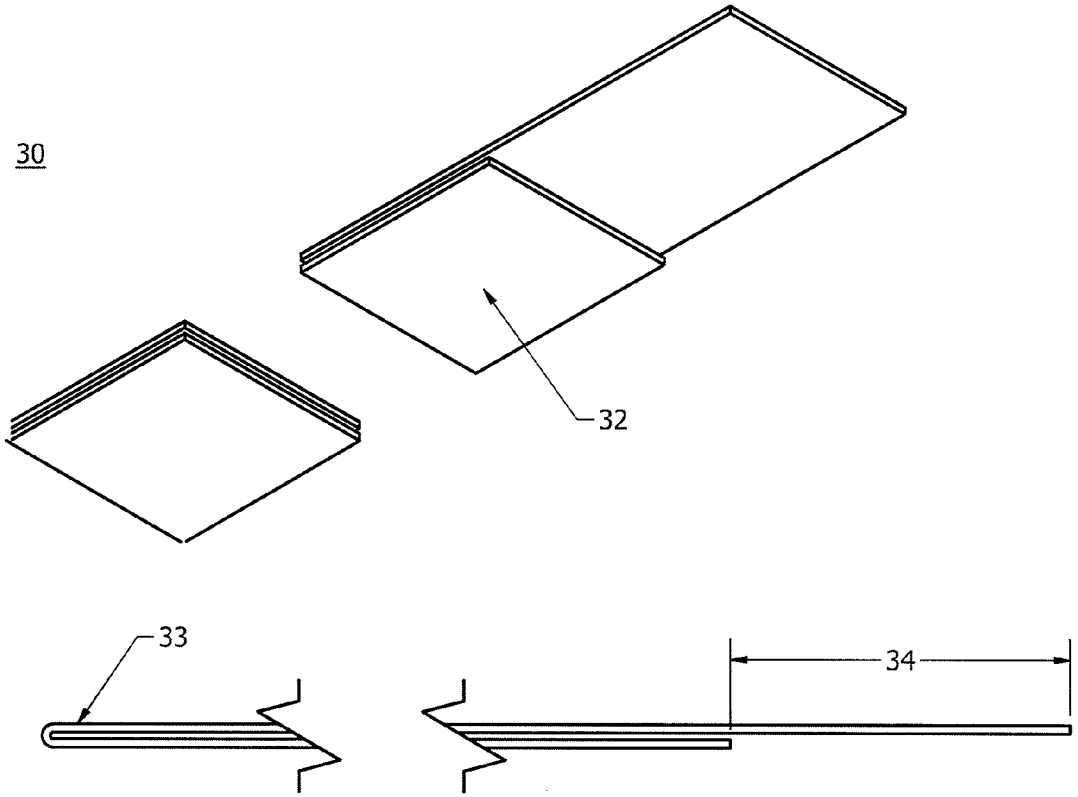
FIG. 5 is a side and orthographic view of a removable release strip utilized to temporarily cover the exposed underlying adhesive strip shown in FIG. 4.

Next, the exposed mounting tape at 28 is covered by a removable folded strip 30, FIGS. 5 and 6. The removable strip 30 may be made of any material that has release properties or a release coating (such as silicone, Teflon and the like) at least on the bottom portion of the strip 30 to prevent adhesion of the removable strip 30 to the exposed adhesive region 28 of the mounting tape 24.

The removable release liner strip 30 may be formed by folding over a single length of material as shown in FIG. 5, forming a first release liner portion 32 which is approximately the same width as the gap 28 in the mounting tape release liner 26 and has a length (preferably but not necessarily at least as long as the gap 28), and a second portion 33 which is longer than the first release liner portion 32, as shown by portion 34. The length of the first release liner portion 32 is dictated by the width of the printing plate 10 (as shown in FIG. 1) and need only be as long as necessary to cover the exposed adhesive in the region 28 that would be under the printing plate 10 when the printing plate has been slid over and positioned onto printing plate cylinder assembly 23, shown in FIG. 6A, and to prevent contact of the plate with exposed adhesive as it is being slid over and positioned onto the printing plate cylinder.

Figure 6A:
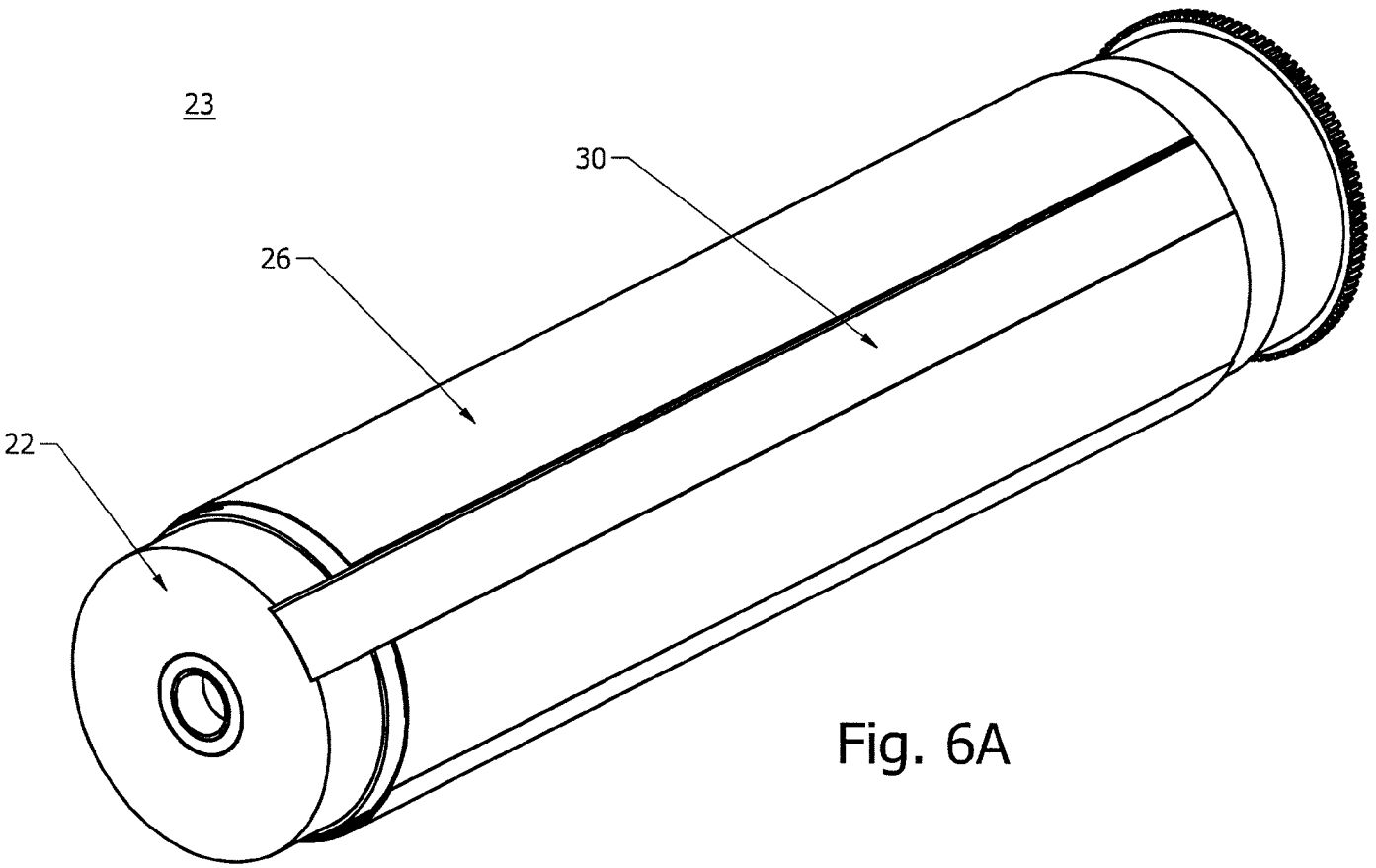
FIG. 6A is an orthographic view of the plate cylinder of FIG. 4 on which has been provided the removable release strip shown in FIG. 5.
Figure 6D:
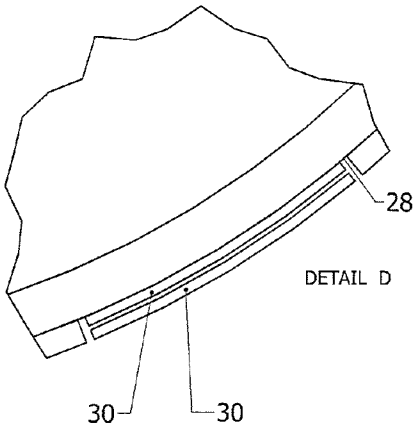
FIG. 6D is a detailed enlarged view of region "D" in FIG. 6B.
Figure 6B:
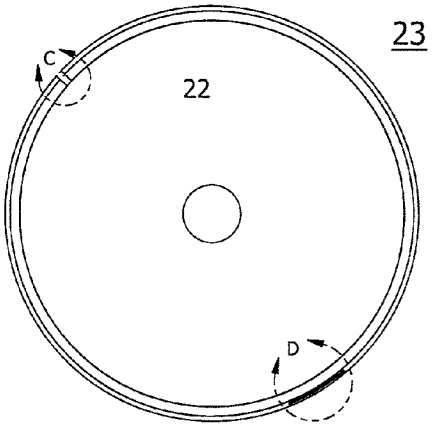
FIG. 6B is a cross-sectional view of the printing plate cylinder of FIG. 6A.
Figure 6C:
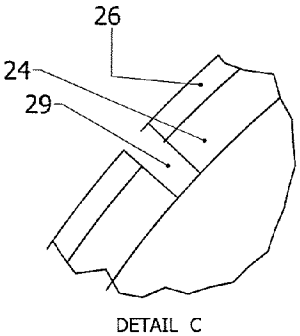
FIG. 6C is a detailed enlarged view of region "C" in FIG. 6B.
Figure 12:
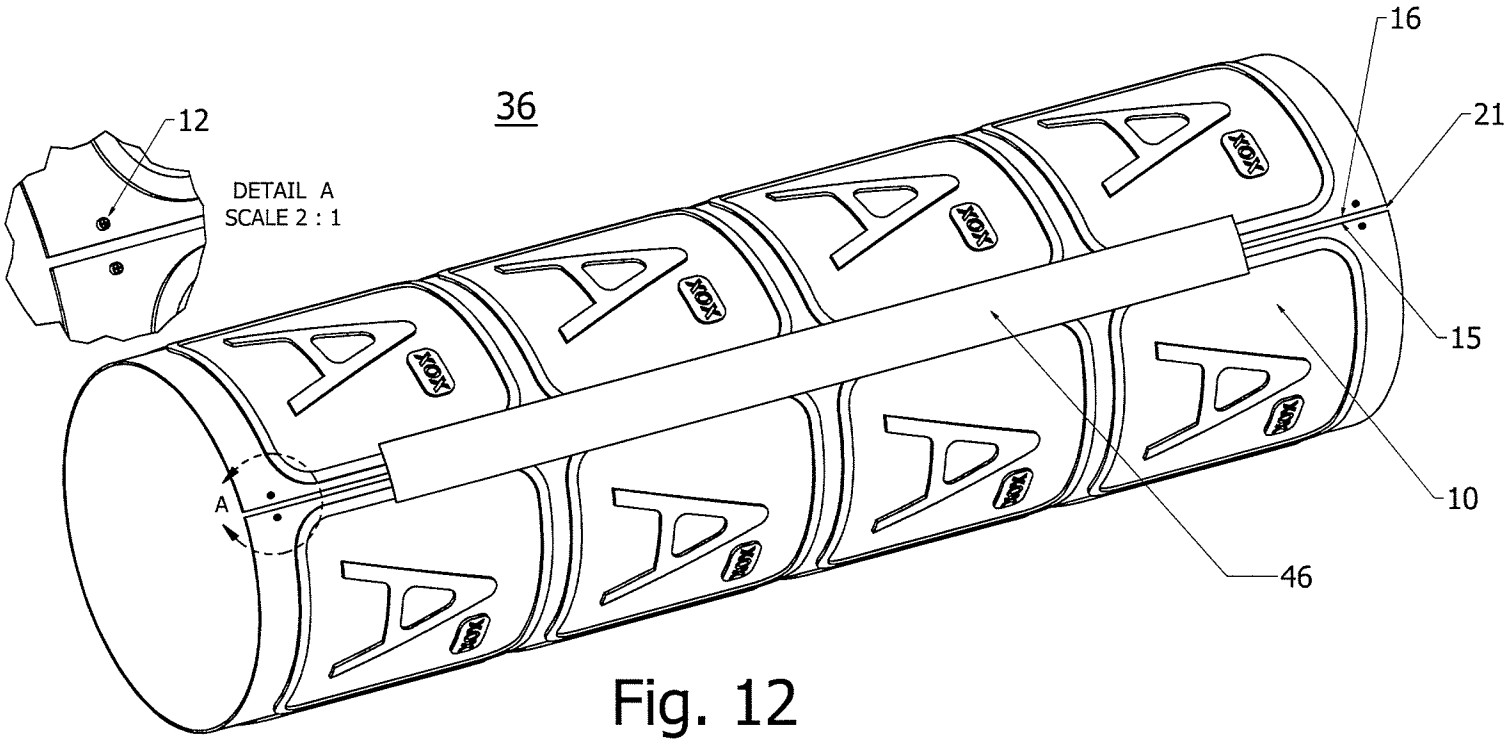
FIG. 12 is an orthographic view of the aligned printing plate temporarily held in place by a piece of tape in accordance with the teachings of the present invention.

The slightly longer portion 34 sticks out or protrudes from under the printing plate 10 when the aligned and taped printing plate 36 in FIG. 12 is slid onto the plate cylinder assembly shown as 23 in FIG. 6A. It is also contemplated to have multiple release strips 30 laid parallel to and abutting each other around the circumference of the printing cylinder 22. It may be desirable to apply two release liner strips 30 co-linear with folded ends proximate or abutting each other at or near the center of the printing cylinder. This may be helpful for wider plates.

Figure 8:
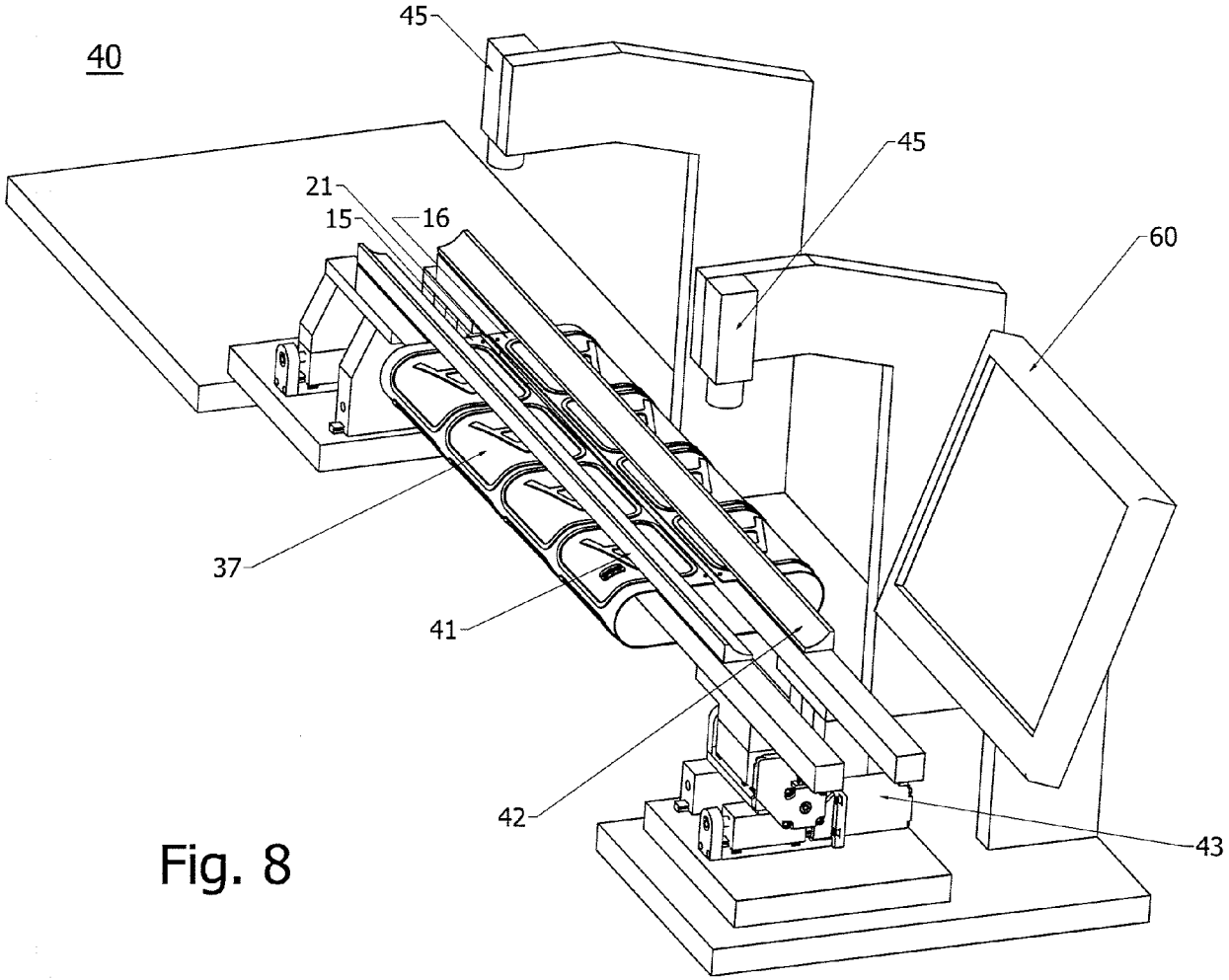
FIG. 8 is an orthographic view of an exemplary alignment device that can be used with methods according to the present invention.

The previous steps of preparing the printing plate cylinder assembly 23 may be performed ahead of time while similarly the next step of aligning the printing plate 10 may occur at any time independent of preparing the printing plate cylinder. At some point in the sequence of steps according to the method of the invention, the printing plate 10 is bent or otherwise formed into a generally circular or oval form 37, FIG. 8, typically on an alignment device such as shown at 40, with the leading and trailing ends 16 and 15 secured using, for example, clamps 41 and 42 (or suction, temporary adhesive, friction, or some other means of securing) or the like provided on the alignment device 40. The alignment device 40 will allow the registration marks 12 to be imaged and/or viewed and their positions determined and adjusted accurately, such as under one or more microscopes, microscopic cameras, or other type of cameras/machine vision system components 45 coupled to a machine vision system processor and/or display 60 on FIG. 8 Then, utilizing either a manual or automatic device, such as, for example, screws, motor controls, or a machine vision system directing a drive mechanism 43, move or rotate either or both ends 15, 16 of the printing plate 10 such that registration mark 12*d* is properly aligned with 12*a* and registration mark 12*c* is properly aligned with to 12*b*. The objective is to properly align the registration marks 12 across the plate gap 21 as shown on FIG. 9. Rather than a device such as shown in 40, a circular form or "mandrel" or some other type of device could be used to properly position the registration marks 12.

Figure 9:
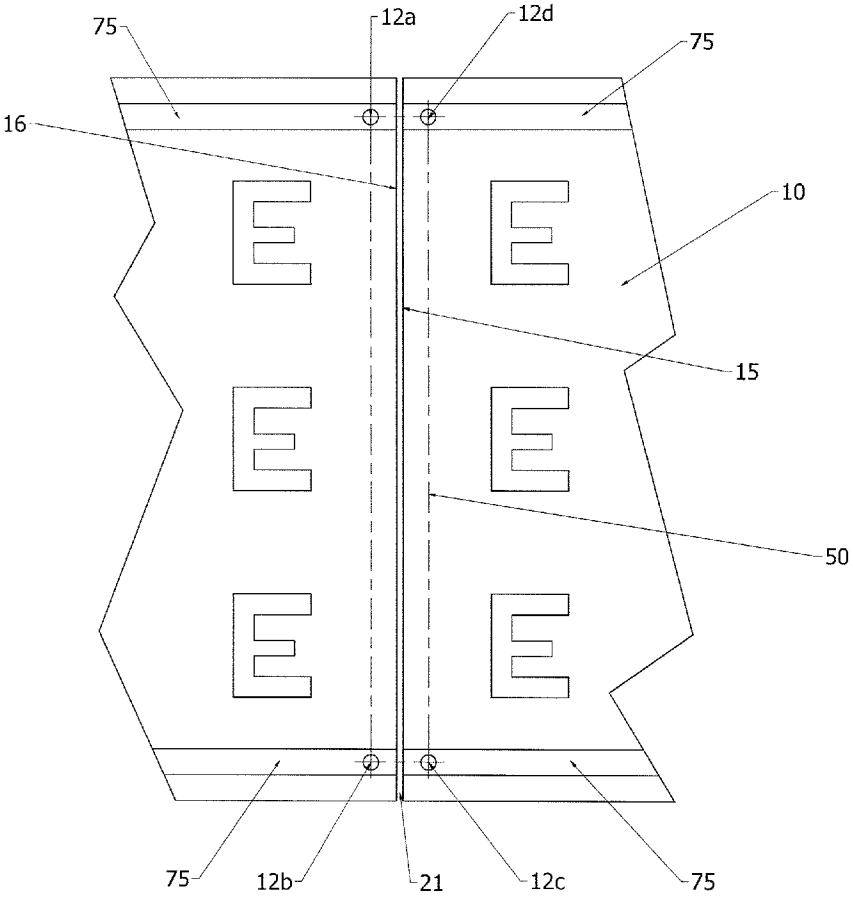
FIG. 9 is a view of the ends of a printing plate aligned in accordance with the teachings of the present invention and including an optional bearer in which the registration marks are located.
Figure 10:
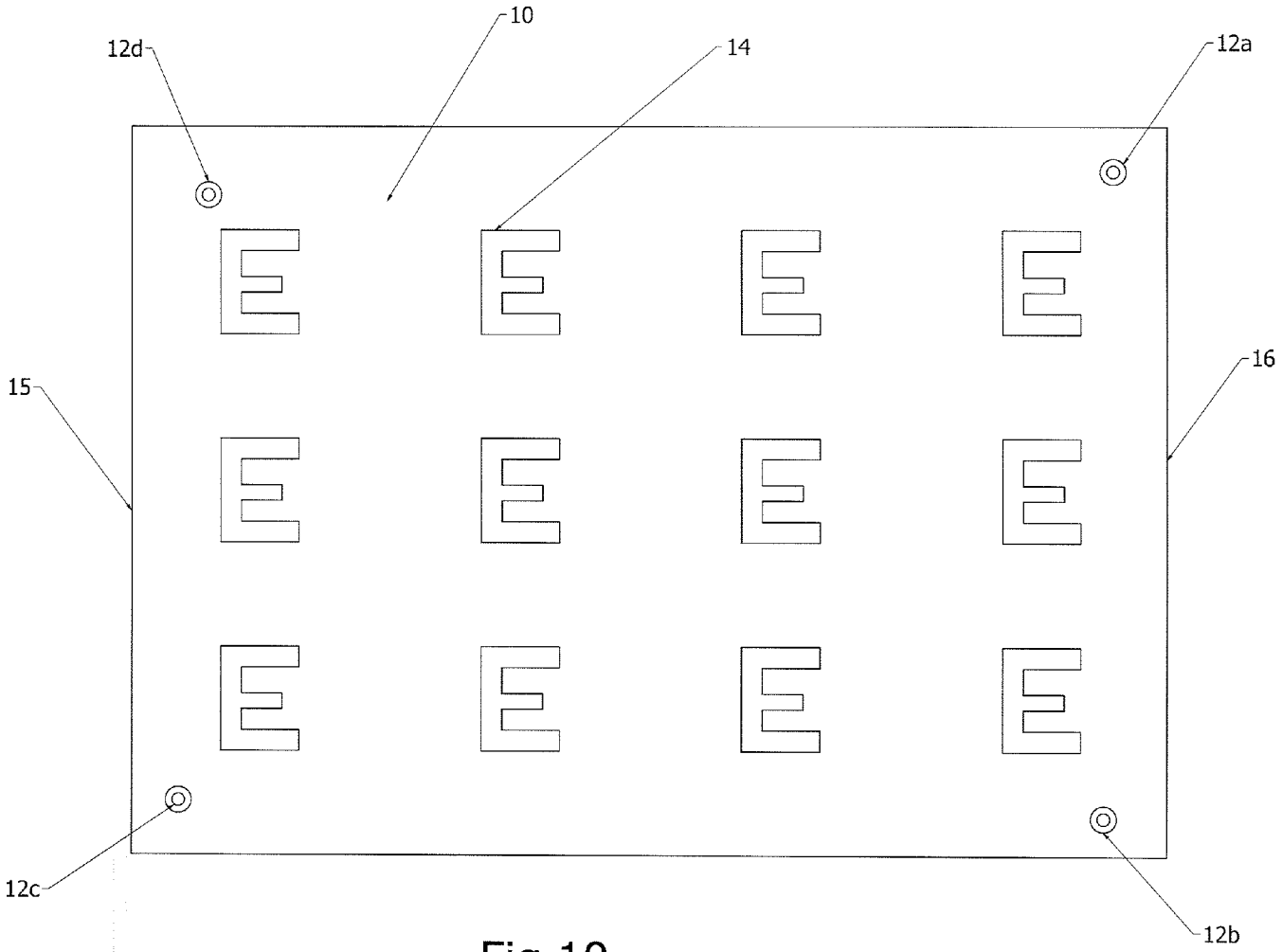
FIG. 10 is a top view of a printing plate having imaged thereon indicia and several registration marks according to another embodiment of the invention.
Figure 11:
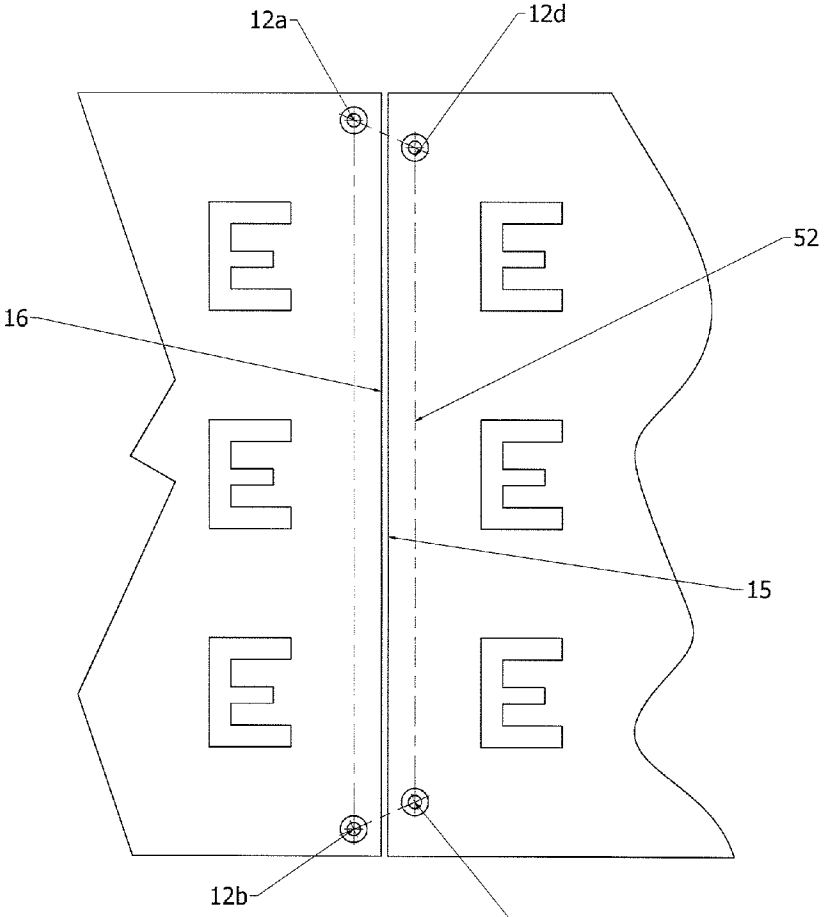
FIG. 11 is a partial view of the ends of a printing plate aligned in accordance with the teachings of another embodiment of the present invention.

In one embodiment, the registration marks 12 are not brought into a predetermined grid but rather, two marks on one side of the printing plate 10 (for example marks 12*a* and 12*b*) are used as reference and the two marks across the plate gap 21 on the other side of the printing plate 10 (such as marks 12*c* and 12*d*) are moved into a predetermined position relative to the reference marks, to form a near perfect rectangle 50 as shown in FIG. 9. In another embodiment as shown in FIG. 11, two of the registration marks 12*c*, 12*d* for example may be positioned differently on the leading, trailing and side ends of the printing plate 10 such that their proper alignment as shown in FIG. 11 may form an isosceles trapezoid 52 or any other predetermined shape. As previously mentioned, the registration marks can be part of the image. As shown in FIG. 10, the registration marks need not be in the same locations on all plates. In addition, the invention can be carried out utilizing only 2 (or more) registration marks provided that there is at least one registration mark on each side of the printing plate gap 21. It is also contemplated by this invention that the registration marks 12 can be free standing; part of the image (i.e. part of a number, graphics, letter or other indicia); or located in a "bearer" 75 as shown in FIG. 9.

Once the registration marks 12 are properly aligned/positioned, the vision cameras 45 and machine vision processing system 60 can record the alignment and positioning for reporting and quality control reasons. In addition, the vision cameras 45 and vision processing system 60 can utilize previously stored position information based on desired positioning or positioning or one or more previous plates 10, to bring the current plate 10 into alignment based on a desired position or based on one or more previously aligned plate(s).

In one embodiment, after alignment the operator then secures the leading and trailing ends 16, 15 of the printing plate 10 to each other with a removable adhesive tape segment 46, FIG. 12. The distances across the plate gap 21 of registration marks 12*a* to 12*d*, and 12*c* to 12*b* of the printing plate 10 must be set such that the now aligned printing plate 10, which is formed into the shape of a cylinder or tube (the aligned printing plate assembly, 36 on FIG. 12), must easily slide over the plate cylinder 22 previously prepared as shown in FIG. 6A now covered with mounting tape 24, removable release liner strip 30, and release liner 26. Care must be taken about the distances of registration marks 12 across the plate gap because those distances control the internal diameter of the aligned printing plate assembly 36, shown in FIG. 12. If the internal diameter is too small, it will be difficult or impossible to slide the aligned printing plate assembly 36 onto the plate cylinder assembly 23, and the previously achieved alignment may be destroyed. If it is too loose, the plate assembly 36 could skew making misalignment possible.

The fit between the internal diameter of the aligned printing plate 36 and the external diameter of the prepared plate cylinder 23 should be a "Close-Sliding Fit", of the type intended for accurate location of parts which must assemble without perceptible play.

Figure 13A:
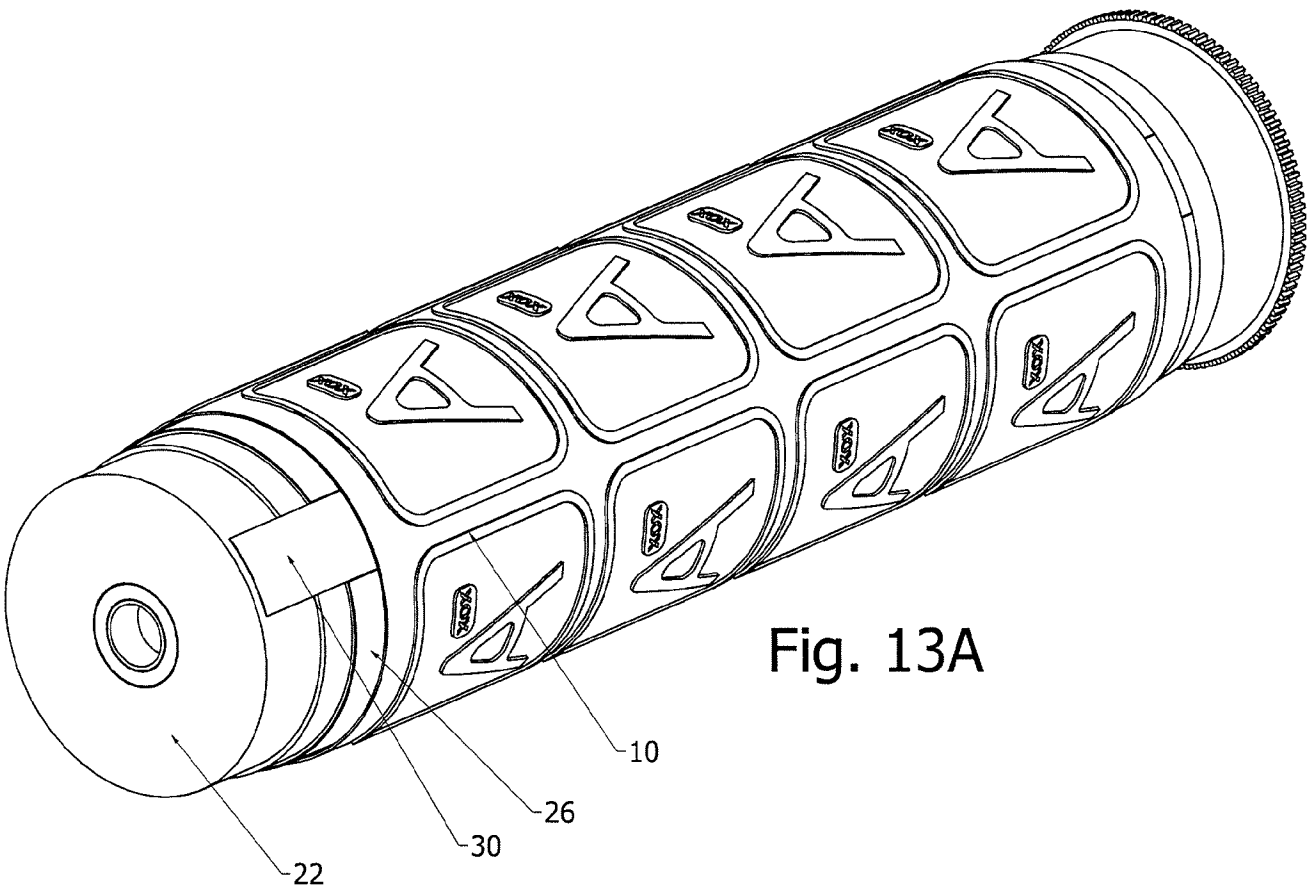
FIG. 13A is an orthographic view of the aligned printing plate of FIG. 12 that has been slid onto a printing plate cylinder awaiting attachment to the printing plate cylinder.
Figure 13B:
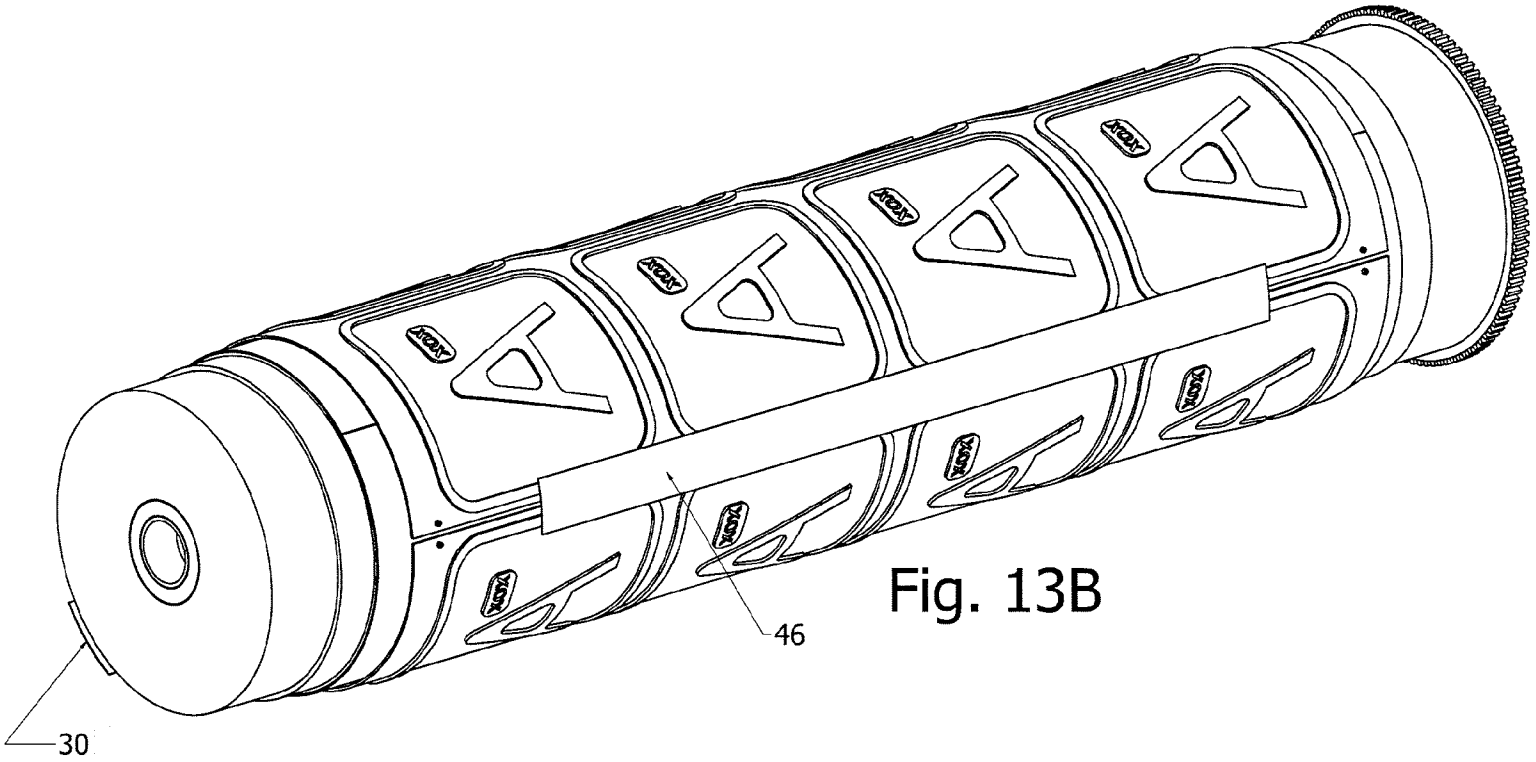
FIG. 13B is an orthographic view of the aligned printing plate that has been slid onto a printing plate cylinder awaiting attachment to the printing plate cylinder of FIG. 13A which is rotated to show the aligned printing plate temporarily held in place by a piece of tape in accordance with the teachings of the present invention.
Figures 14A, 14B, 14C, 14D:
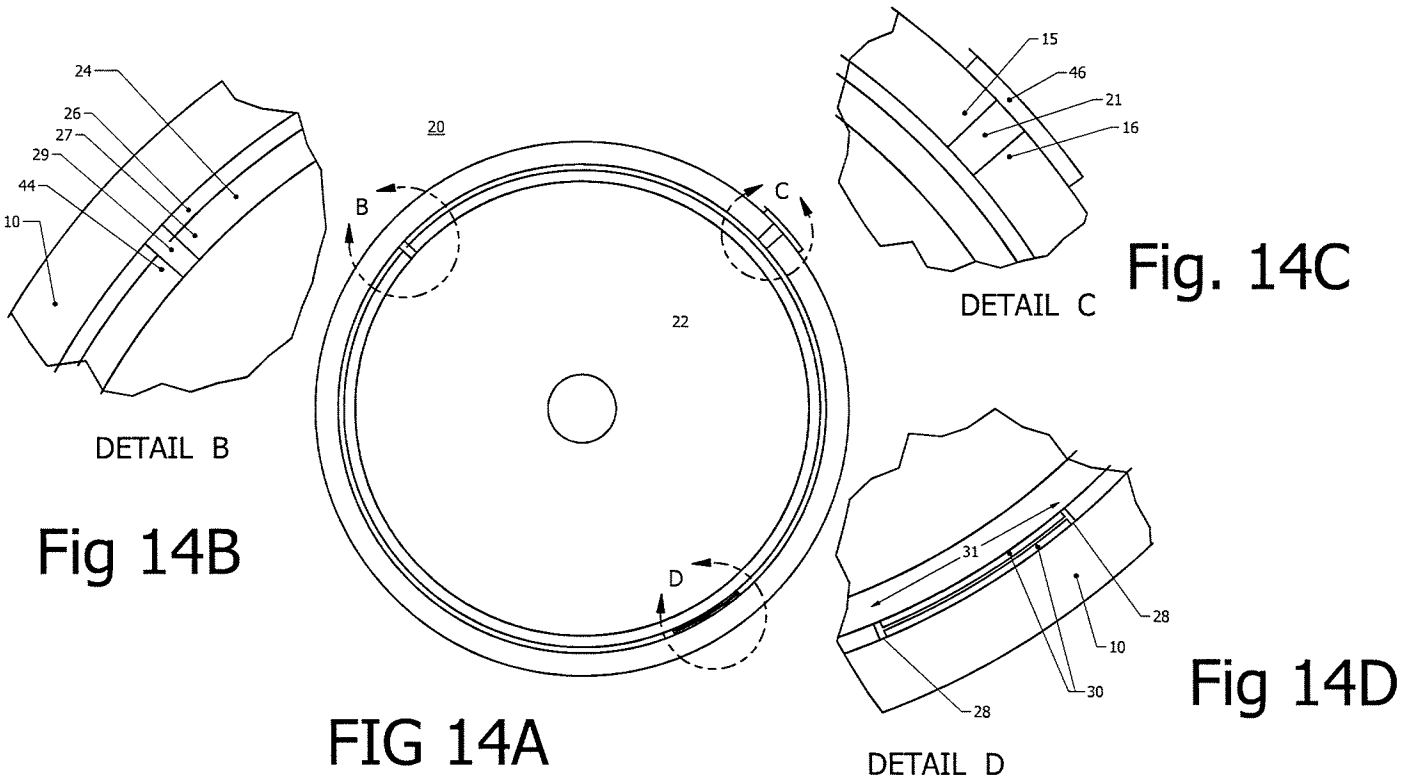
FIG. 14A is a cross-sectional schematic view of an aligned printing plate slid onto a printing plate cylinder.
FIGS. 14B, 14C and 14D are detailed views of areas 14B, 14C and 14D on FIG. 14A.

The operator will then slide the aligned printing plate assembly 36 over the printing cylinder 22 covered with mounting tape 24, removable release liner strip 30 and release liner 26 as shown in FIGS. 13-14. The aligned printing plate assembly 36 may be rotationally oriented in any manner. It is preferable but not necessary that the gap 21 between the leading and trailing ends 16, 15 of the aligned printing plate assembly 36 is not located on top of the narrow strip or gap 28 with release liner removed. In addition, it may be desirable to locate plate assembly 36 at a strategic location relative to the adhesive coated mounting tape gap 29, such as to position the mounting tape gap 29 between image areas on the plate 10 and thus not under any indicia. This is to prevent a printed area from having a void under it, possibly resulting in a plate "low-spot" and subsequent printing defect.

Figure 15:
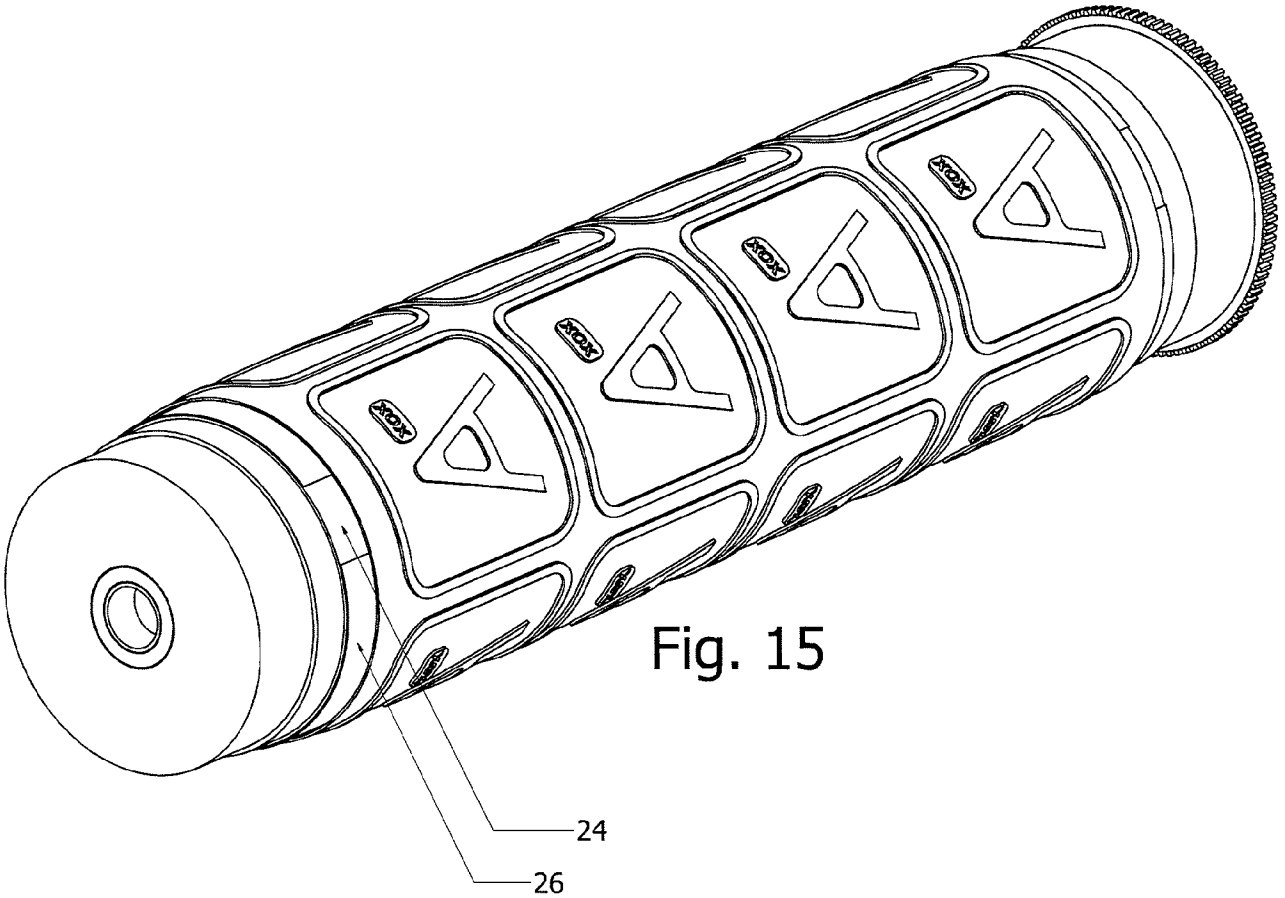
FIG. 15 is an orthographic view of an aligned printing plate which has been secured to the exposed strip of printing plate adhesive mounting tape while the printing plate alignment tape is still attached.
Figure 16:
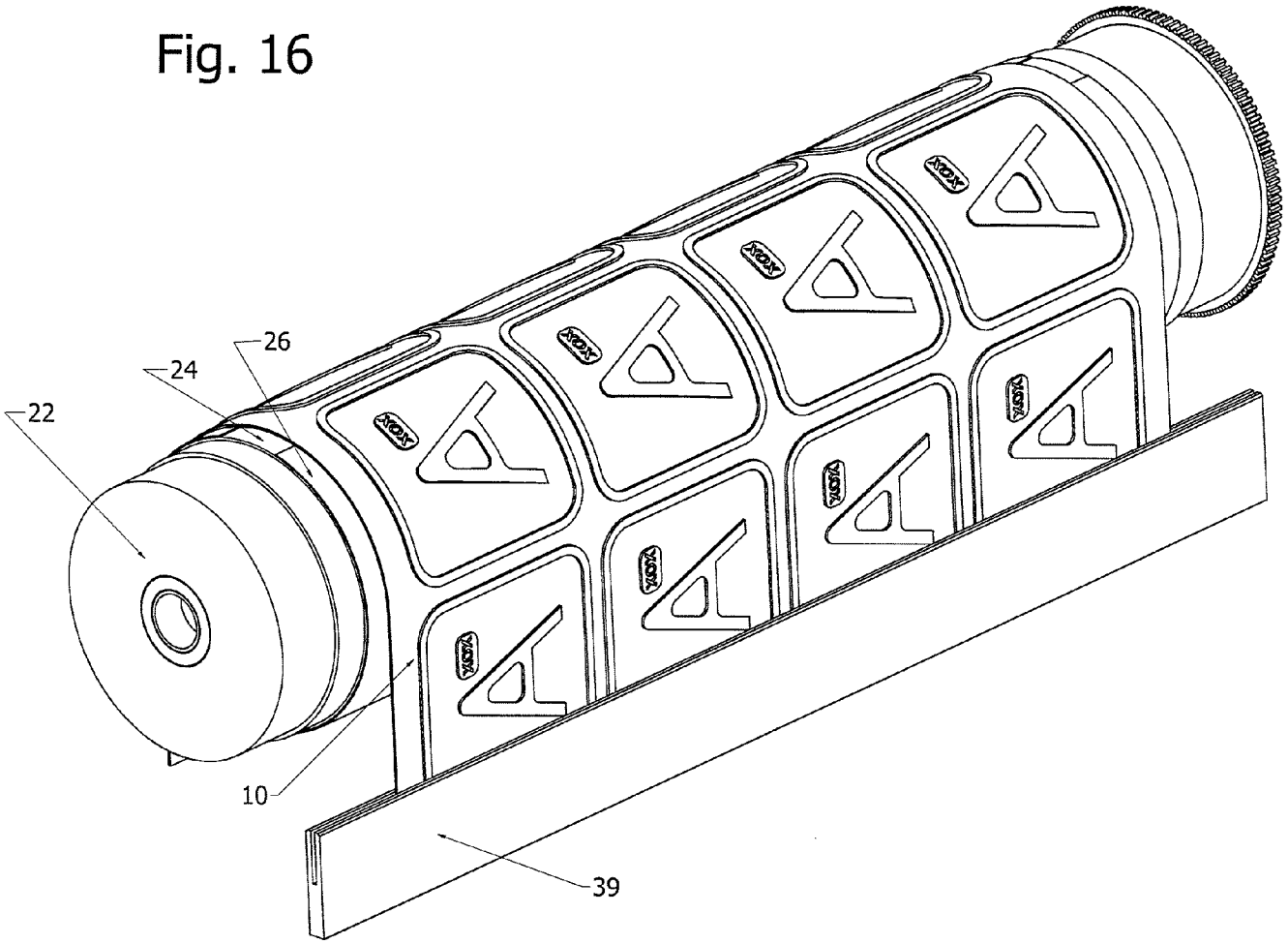
FIG. 16 is an orthographic view of the aligned printing plate which has been secured to the exposed strip of printing plate adhesive mounting tape and the alignment tape removed.
Figure 17C:
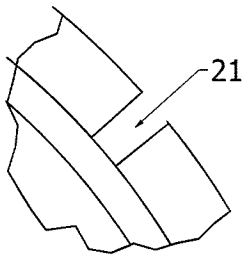
FIG. 17A is a detailed cross-sectional view of the aligned printing plate which has been fully secured on the printing plate cylinder with FIGS. 17B and 17C showing in detail the printing plate adhesive gap and the aligned printing plate gap, respectively.
Figure 17A:
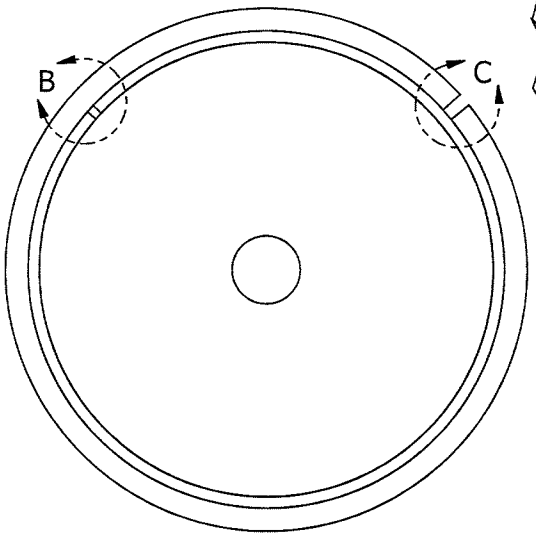
Figure 17B:
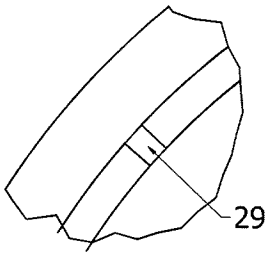

The operator next removes the release liner strip 30 by pulling on the exposed end 34 (or multiple ends 34 if more than one strip 30) leaving an axial strip 28 of adhesive on the mounting tape 24 exposed, FIG. 15. The operator, manually or with the aid of machinery, then presses the aligned printing plate 36 onto the one or more axial strip(s) of mounting tape 24 exposed at location(s) 28. When the operator is satisfied that the aligned printing plate 36 is firmly adhered to the exposed strip of mounting tape 28, she or he removes the tape 46 placed across the gap 21 in the aligned printing plate 36 leaving the leading and trailing ends 16,15 of the printing plate free, FIG. 16. The operator then removes the remaining release liner 26, and carefully adheres the aligned printing plate 36 to the remaining mounting tape 24. This may be done manually or there may be provided a device or mechanism, for example, which includes mechanical (not human) means to hold the printing plate ends 15, 16 such as the clamp 39 in FIG. 16, applying equal, uniform, constant and non twisting tension, and roll the plate 10 onto the mounting tape 24 as shown. The printing plate and printing cylinder assembly is now completed, properly aligned as shown in FIGS. 17 and 1 and ready for use in a press. The tension of this plate application should be equal for all plates in a set unless conditions indicate otherwise.

An important feature of this invention is that the positioning of the registration marks 12 across the plate gap 21 of plate 10 achieved in the aligning device 40 (or some other device or by some other method), is maintained when the plate is subsequently attached to the exposed adhesive band of mounting tape in the section of liner removed 28 in FIG. 4; and, that after removal of all of the release liner 26, this alignment, when compensated for the removed liner, is maintained when the plate is finally attached to the adhesive member 24 as shown in FIG. 1.

Using this system and method, each and every generally flat, planar object with registration marks, such as printing plates, will be arranged in a circular format mounted on a printing press plate cylinder in near perfect alignment, thereby essentially eliminating misalignment and/or skew caused by improperly aligned printing plates. When the user has completed the printing process, the printing plate 10 may be removed from the printing plate cylinder 22 as is well known in the art. The printing plate cylinder 22 may be stored or used for another job and the printing plate 10, now in a flat form, may be easily stored for potential future use.

Up to this point, new and unique equipment, systems and methods consisting of a number of steps have been described to more accurately align flexographic printing plates to flexographic plate cylinders using flexographic mounting tape as is the conventional method and practice. The objective is to produce a set of one or more accurately aligned plate and cylinder assemblies ready to be installed into a printing press to run a printing job or a series of related jobs. However, issues such as operator inattention or mistakes, or plate cylinders or mounting tape (stickyback) that are out-of-spec, or equipment out-of-calibration could result in unacceptable alignment accuracy. What is needed is a system and method to perform a final quality control check before going to press and risking waste and downtime.

Another element of this invention is equipment, systems, and methods needed to measure the accuracy of plate mounting of each completed plate and cylinder assembly. Utilizing systems such as shown as 70 in FIG. 18, once the measurements are made for each printing plate and cylinder assembly 20, the accuracy of alignment of each individual mounted printed plate cylinders can be verified and documented, while the interrelationships of the accuracy of all the mounted printing plate cylinders one to another may be computed. An algorithm analyzes these data, reports the quality of plate mounting accuracy and suggests corrective action if needed. With this information available, staff and management can make the decision to continue with printing the job or take corrective actions. Unnecessary downtime, slower production speeds, higher waste and reduced quality caused by going to press with inaccurate plate mounting are avoided. Reports can be generated and transmitted inside and outside the organization as desired.

Figure 18:
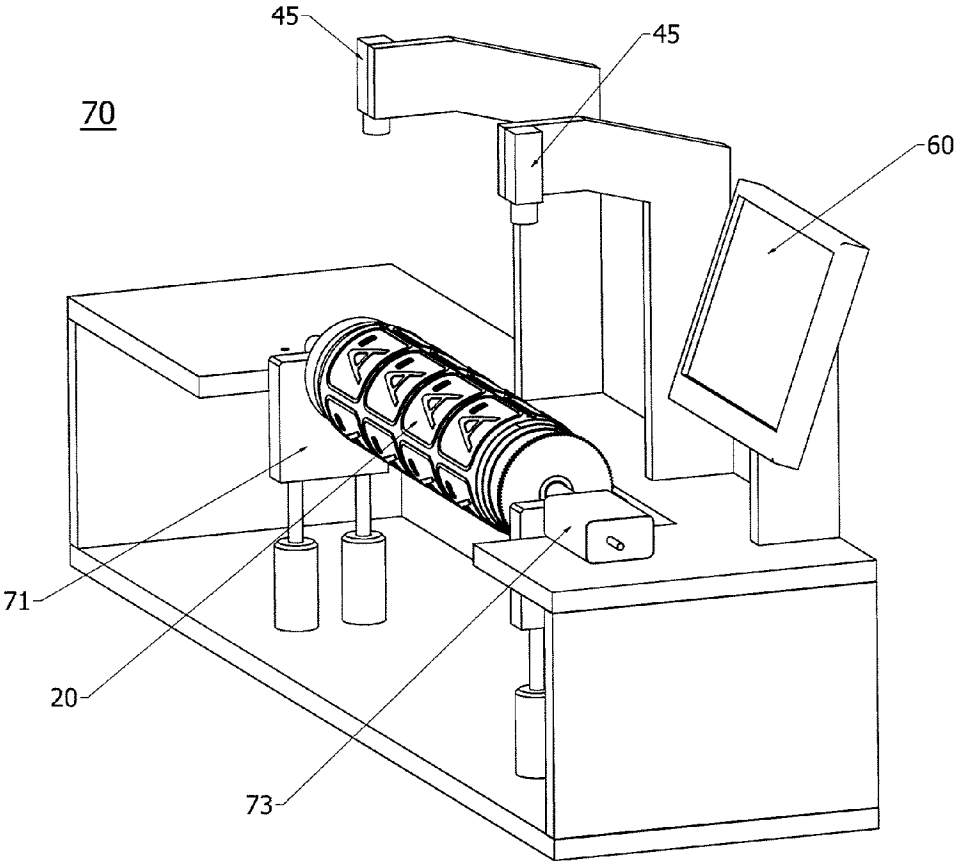
FIG. 18 is an orthographic view of an exemplary alignment device that can be used with a method according to the present invention.

One embodiment of this aspect of the invention is shown at 70 in FIG. 18 and consists of: a fixture or stand 71 used to hold the mounted plate cylinder 20; one or more machine vision cameras 45 positioned over the registration marks 12; and, a computer 60 for running the vision software, performing analysis of measurements and suggested actions; and, other commonly used equipment to record, transmit, and report the results. Equipment and methods such as this could be used to measure and analyze the printing plate alignment accuracy of printing plates mounted by other methods and machines such as currently being used in the field. Because the equipment such as shown as 70 in FIG. 18 can be equipped with vision cameras (45) and a stepper motor 73, rotary shaft encoder, or some other device, the rotational and lateral position of each point on the mounted plate 10 can be accurately detected and measured relative to a virtual target image and/or to other plates for a given print job. The points so detected may be registration marks such as 12 shown on FIG. 7 or elements of the indicia, such as the dot in the lower case letter "i". There can be one or more target or registration marks (2 dimensional or 3 dimensional) anywhere on the plate or image.

Printing is a 2-dimensional process. Typically, a flexographic printing press has multiple stations (almost always of a different color). Each station prints an image (or a multiple of the same image) of the specified color each based on a different printing plate. The combination of these images produces the final printed graphic (a picture, a label, a document, etc.) For the final printed product to be acceptable, the individual images must be very precisely registered one to another (however the degree of precision required and which will be acceptable depends on the nature of the final printed graphic and perhaps to some extent on the amount of out of registration allowable for the final printed graphic). This invention pertains to the element of registration controlled by the plate-mounting step.

The 2-D character of the graphic lends itself to mapping, such as X-Y measurements. Thus, every element of each image has a target X and Y position. The equipment (vision cameras 45, stepper motor 73 rotary shaft encoder, or other devices including data processing equipment 60) can monitor and determine the rotational and lateral position of each point on the mounted plate 10 and X-Y measurements of these points are known and can be measured and the measurement stored for quality control reporting and position repeatability. The rotational position of the plate cylinder is known by the stepper motor system, measured say in degrees. The machine vision cameras can be used to measure the X and Y coordinates of the elements, report the errors from where they should be for a given rotational angle, and feed that information to a computerized analysis algorithm. In this way any number of target positions can be analyzed and recorded.

One example of this concept would be if each plate had say 10 target registration marks. After mounting, the machine could measure the x-y position of these marks to determine their accuracy and record their exact position. It is evident that it is not be mandatory for the registration marks to be in the same spot on each plate, you just need to know where they should be and that they be aligned one plate to another. Also, elements found within the images (a certain "dot" on a letter "i" for example) could be used for this measurement.

Figure 19:
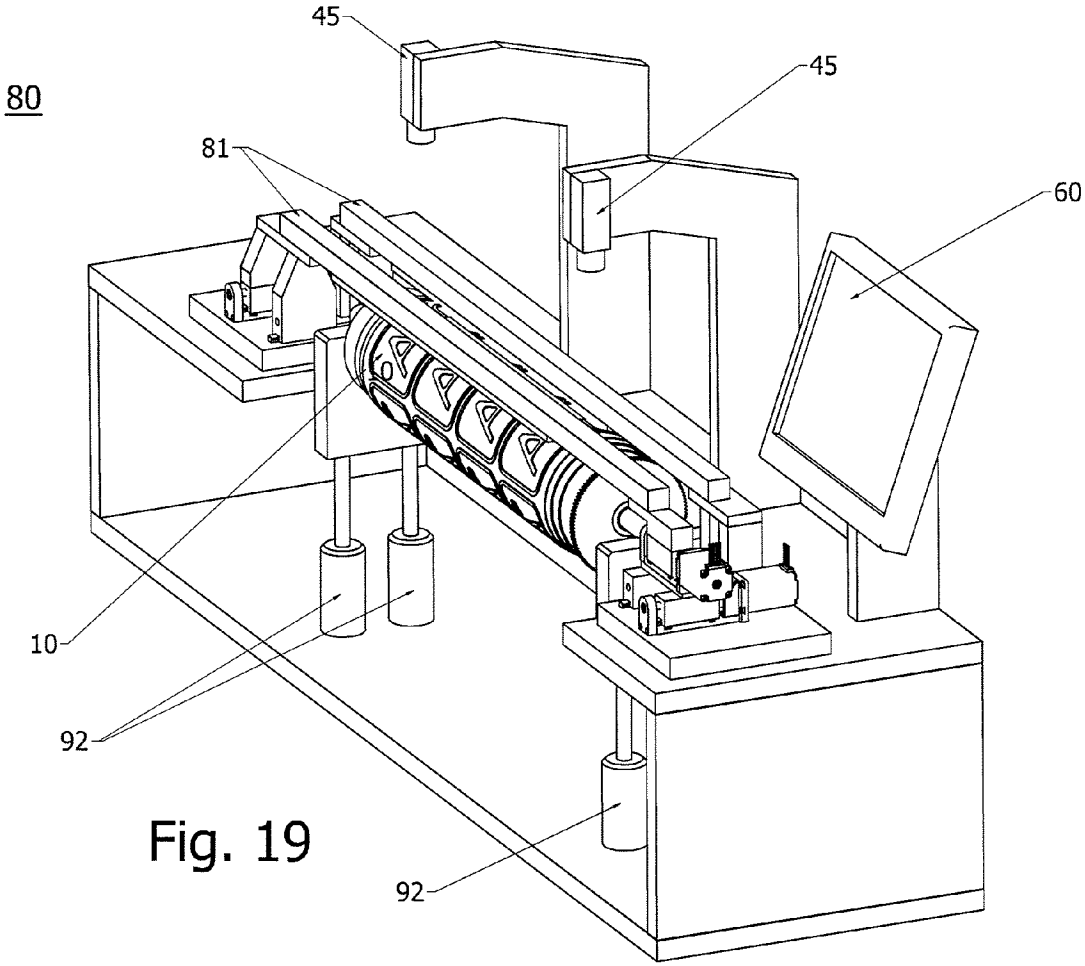
FIG. 19 is an orthographic view of an exemplary alignment device that can be used with an alternative method according to the present invention.

In another embodiment according to the present invention, the method begins by preparing the assembly 23 of FIG. 6A of the printing cylinder 22 covered with mounting tape 24 on which has been removed a section or gap 28 of release material 26, and into which has been provided a section of removable release liner 30 as has been previously described. This assembly is then placed into machine 80 in FIG. 19. (In another embodiment, these steps of preparing the plate cylinder could be accomplished in machine such as 80 appropriately equipped). The printing plate 10 is then wrapped around the cylinder so prepared and secured utilizing clamps 81, adhesive, friction, or the like. The leading and trailing ends 16 and 15 of the printing plate 10 thus secured and wrapped around the plate cylinder 22 are adjusted automatically or manually by moving the clamps, using microscopes, electronic cameras 45, machine vision control and/or processing/display systems 60, or the like such that the registration marks 12 on the printing plate 10 are properly positioned.

The printing plate 10 is then secured to the printing cylinder 22 in the manner described above by first removing liner strip 30 (not visible in this figure), thus bonding a section of the plate to the exposed adhesive 28 of stickyback 24, releasing the clamping mechanism, and completing the attachment of the plate 10 to the mounting tape 24 by removing the remaining liner section(s) 26 and carefully applying the remaining portions of the plate 10 onto mounting tape 24. This method eliminates the need to prepare and slide a taped assembly 36 over a cylinder and may be desirable for wide web applications.

Figure 20:
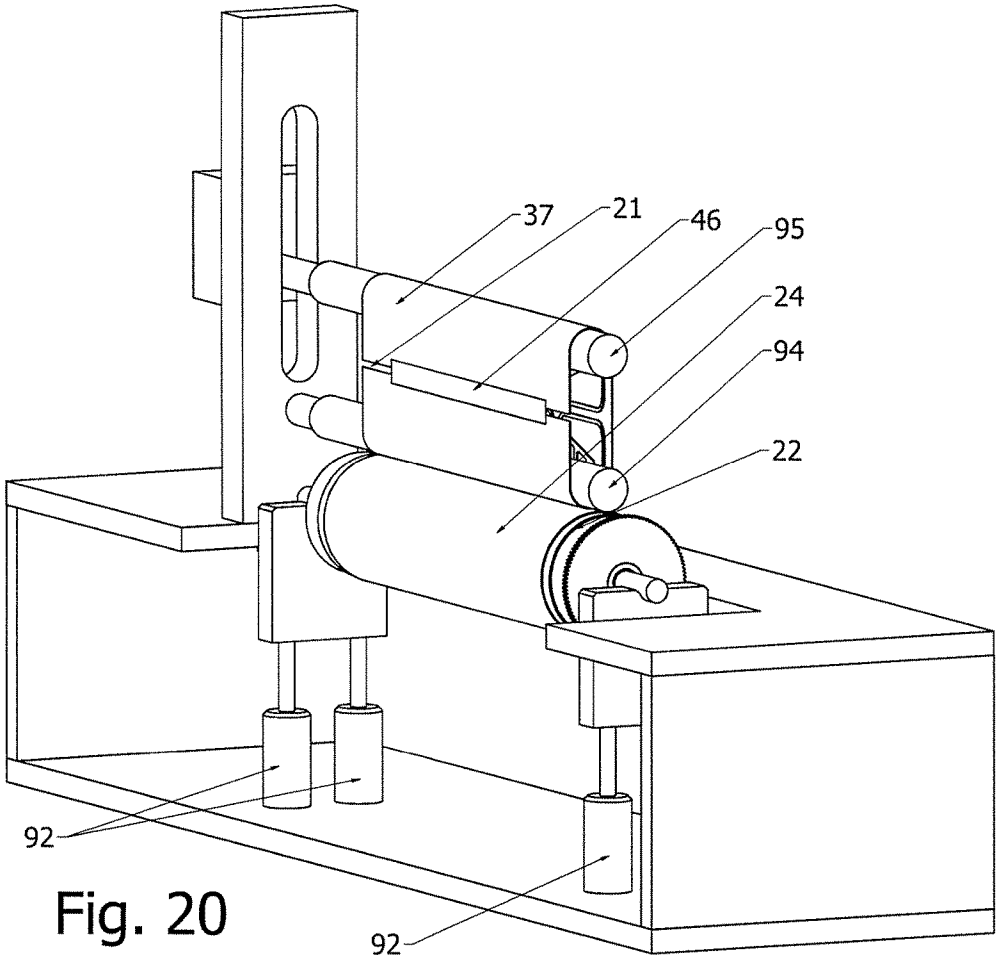
FIG. 20 is an orthographic view of an exemplary alignment device that can be used with yet another alternative plate method according to one embodiment of the present invention.

In another embodiment of the present invention the plate 10 is formed into a circular or oval element 37 FIG. 20 and the registration marks 12 on plate 10 are aligned in a manner similar to previously described except that the printing surface (graphics, indicia 14, etc.) is located on the inside of the circular or oval element 37. This alignment is performed on a machine such as 40 shown in FIG. 8, which is capable of detecting and measuring the positions of registration marks 12 located on the inner surface of said circular or oval element 37 by looking through transparent plate material or using optics, cameras, etc. located on the inside of the circular or oval element. After alignment is achieved, the leading and trailing ends are secured in position using tape 46 to maintain the positions of the registration marks.

A plate cylinder 22 loaded into machine 90 of FIG. 20 is covered with mounting tape 24 as previously described and the mounting tape liner 26 is totally removed. The circularly bent and taped plate 37 (with print surface inward) is positioned around two rollers 94 and 95, which are parallel to axis of the plate cylinder 22 mounted on this machine. The rollers are separated while staying parallel to each other and the plate cylinder 22 axis such that the plate 37 forms a taut oval shape without stressing the taped gap 21 or distorting the plate 37. Then, the plate cylinder with adhesive exposed stickyback 24 is moved to contact the assembly consisting of rollers 94, 95 and taped plate oval 37, using a lifting mechanism such as the jacks shown as 92. Alternatively, the plate oval 37 and roller assembly of 94 and 95 could be moved (lowered) to contact the surface of the plate cylinder with adhesive exposed stickyback 24. The cylinders and plate 37 are rotated to achieve a band of attachment of the plate to the exposed stickyback. The tape 46 is then removed and the rest of the plate is attached to the exposed stickyback 24. The mounted plate cylinder shown as 20 in FIG. 17 is now ready for insertion into a printing press and production commenced. However, as stated previously, it is likely that a quality control procedure on a machine such as 70 shown in FIG. 18 and previously described would be required before going into production. Alternatively, the machine shown as 90 in FIG. 20 could be supplied and provided with equipment to perform such quality control procedures.

A feature of this invention addresses major weakness of the current state of art namely tension control of the stickyback application to the plate cylinder; controlled initial attachment of the aligned plate to the stickyback surface; and tension control and skew control of the plate application to the stickyback surface.

A unique and important feature of this invention is that the mounting tape with release liner (i.e. stickyback) is applied to the plate cylinders with controlled tension utilizing a tension control system and a motor drive system. Since many of the mounting tapes in use are compressible (e.g. 0.020 inch thick foam), varying application tension causes varying compression and thus variation in the circumferences of the surfaces to which the printing plates are subsequently attached. This will cause mis-registration since the space between images across the plate gap of the printing plate 10 would vary. Also, varying compression may create low spots in the printing surface that could result in printing defects. For example, the current practice is to manually perform all the steps to apply the stickyback. It pushes the limits of human capability to manually apply stickyback with the degree of tension control required to achieve the tolerances needed in close register flexographic printing.

The theory of accurate plate mounting guiding another embodiment of this invention is as follows: An imaginary line drawn between the two registration marks for mounting, such as registration marks 12*a*-12*d* shown in FIG. 7 must be parallel to the rotational axis 110 FIG. 3 of the plate cylinder 22 when the plate is attached by stickyback 24 to the plate cylinder 22. All the plates 10 in a set for job preferably but not necessarily have their marks in the same relative location.

Figure 22:
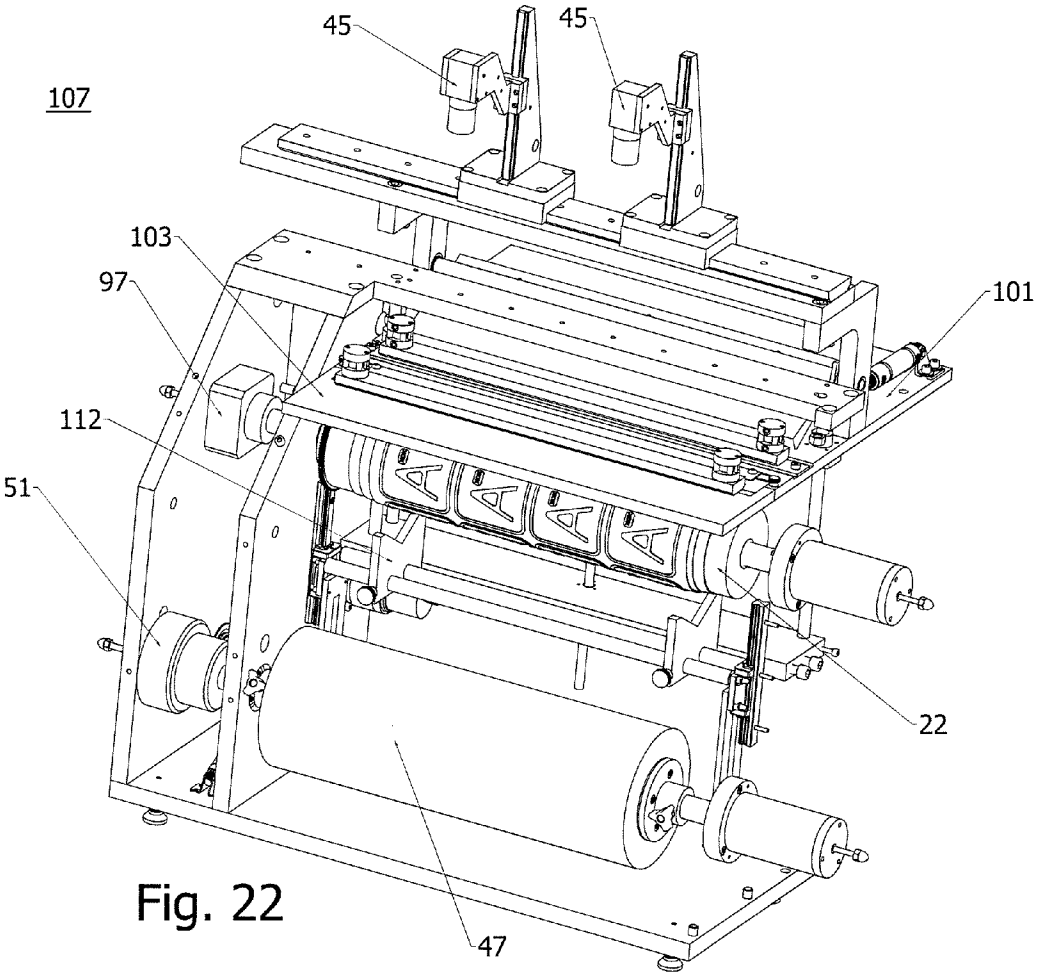
FIG. 22 is an orthographic view with right side removed of a plate mounting machine according to one feature of the present invention.
Figure 23:
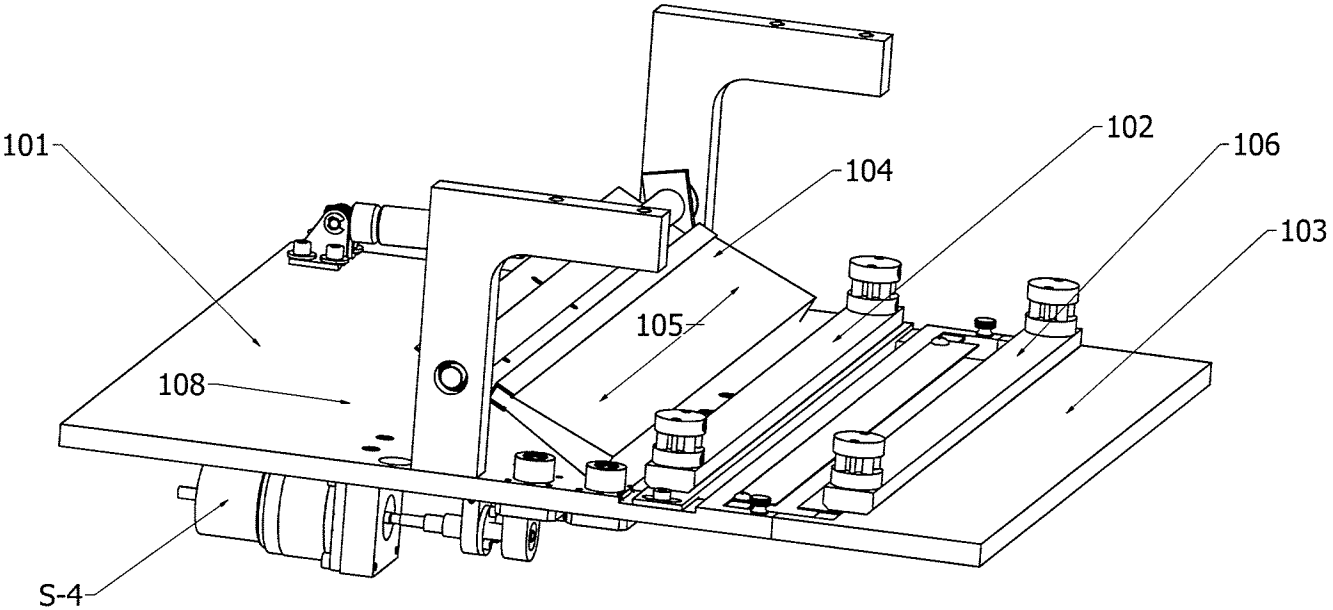
FIG. 23 is a side view of the plate table assembly used in the plate mounting machine of FIG. 22.

In the present invention, a previously imaged and trimmed flexographic printing plate 10 is placed on the table 101 FIGS. 22-23 of a plate mounting machine 107 which has been previously loaded with a plate cylinder 22 and covered with stickyback as described above. Two or more registration marks for mounting 12 are detected by the machine vision system 45. Under the control of the machine vision system vision cameras 45, a clamp mechanism 102 moves the plate such that the imaginary line drawn between two or more registration marks is parallel to the rotational axis 110 of the plate cylinder 22.

Once the plate 10 is aligned in the flat on table 101, it must be attached to the plate cylinder 22. Typically this is done by manually bending the protruding edge of the plate thus attaching this edge to the plate cylinder. Sometimes the attachment is in the center or some other region of the plate. Then the plate is manually rolled onto the cylinder while holding it by hand. The current method however has a high potential for skew since it is very difficult by hand to make the initial attachment to the required level of precision; introduces varying tension during plate application causing variable stickyback compression resulting in low spots (printing defects) and variation of the image space across the plate gap; and introduces skew forces, resulting in mis-register, if the manual holding force is not perfectly square.

In the present invention, once the plate is aligned in the flat, the protruding edge is held between two clamps 102, 106. A small band of the plate 10 (i.e. ¼ inch) is exposed between the back and front clamps 102, 106 FIG. 23 located at the front of the table 101 following which the plate 10 is laid under precise control onto the stickyback 24 on the printing cylinder 22 such that the entire width of the printing plate 10 contacts the stickyback 24 on the printing cylinder 22 at the same time. This prevents skew, which is propagated as the plate is wrapped onto the plate cylinder.

Once the narrow band of the plate 10 is attached to the stickyback, with the imaginary line between two registration marks parallel to the plate cylinder axis, the plate cylinder 22 is rotated and the rest of the plate 10 is attached. The equipment and process utilized in the present invention controls the tension on the plate during this process to prevent variations in stickyback compression and the attendant problems described above. One method of such skewless tension control employs a strip brush 104 mounted above the plate 10 (not shown in this drawing) and oriented perpendicular 105 to direction 108 that the plate moves as it is applied to the cylinder 22. The controllable pressure between this strip brush 104 and the top surface of the plate 10 creates pressure between the bottom of the plate 10 and the top of table 101. When the plate 10 now partially attached by stickyback 24 to the plate cylinder 22 is pulled onto the plate cylinder 22 when the plate cylinder 22 is rotated, the friction between the moving plate 10 and the stationary table top 101 creates a controllable (i.e. constant or consistent) tension on the plate.

Because close-fit printing may require registration accuracy equal to or less than 0.003 inch, and since there are variables other than plate mounting affecting final registration (e.g. press dynamics, substrate variations in gage and tension, mechanical components), it is very difficult to manually mount plates to the required level of accuracy considering the many critical manual actions that exist in the current practice. This invention strives to automate and use precision machine control for the critical steps.

In an alternative embodiment, the printing plate 10 in FIG. 7 contains multiple sets of registration marks along its machine direction (most likely at the outer edges such as in the bearer bars). An example would be repeating the marks 12*d*-12*c* and 12*a*-12*d*. Since Stepper Motor 49 FIG. 23 knows its position, it can be used as location reference. For example, if there are equally spaced 6 sets of marks around the cylinder, each set should be separated by 60°. Thus if and when the plate cylinder 22 is rotated and the spacing between the reference position and the measured position is other than a multiple of 60°, there is an error. Likewise, the error perpendicular to the machine direction can be determined since all the registration marks should be displaced the proper amount from the reference set. Usually this displacement will be 0°. Given that error measurements can be made, this opens the door to methods of controlling and reducing the errors by automatically applying appropriate forces in terms of constant and controlled tension to the plate as it is wrapped on the cylinder.

To achieve the objectives of accuracy, speed, reduced skill, and robust machinery/process, the present invention utilizes a unique combination of automation technologies currently available along with specialized computer software programs. For example, the present invention utilizes: Sensors, including position sensors such as limit switches, proximity switches, computerized machine vision systems; External Inputs such as keyboard, touch screen barcode scanning, voice, mouse, switch, etc.; actuators, stepper motors, pneumatic valves/cylinders (perhaps torque motors and various braking systems); and data Processing and Logic including machine vision, computer control and programmable logic controllers.

Stepper motors control many functions: linearly by lead screw mechanisms (S1, S3, and S4 below) and rotationally by direct or belt/chain drive (S2 below) for example, stepper motor positions include:

S1-Stepper: Table vertical position, using a lead screw mechanism. Since the cameras are rigidly attached to the table, S1 Also controls the position of the cameras relative to the cylinder;

S1-A: Home position up

S1-B: Position for cutting leading edge of stickyback

S1-C: Position to cutting trailing edge of stickyback

S1-D: Position to measure register and align marks

S1-E: Position to initially attach the plate to the PC stickyback

S1-F: Position to roll plate onto PC

S1-G: Position near the end of the plate roll onto PC; perhaps table gradually rises to this level as the leading edge comes into the vicinity of the table straightedge so that the leading edge clears the straightedge S1-H: Measurement and Certification position Note: positions S1-B→S1-H are dependent on the plate cylinder diameter, stickyback thickness with liner and stickyback thickness without liner.

S2-Stepper: Rotation of the plate cylinder, using a lead screw mechanism

S2-A: Position to initially attach the stickyback

S2-B: Position to make leading edge trim of stickyback

S2-B→S2-C: Rotation to apply stickyback and rotate to position for trimming trailing edge of stickyback S2-D Position to attach plate to stickyback on plate cylinder S3-Stepper: Elevation of the v-block assembly S3-A: Home position for loading and unloading plate cylinder onto v-blocks S3-B: Position of cylinder for application for clamping into Plate Mounting Machine (PMM), varies with plate cylinder diameter S4-Stepper: Alignment: Under the control of the Machine Vision system, this stepper pivots the back clamp to align the Plate (alignment is when imaginary line connecting the registration marks is parallel to the Plate Cylinder axis)

S4-A: Home: Centered in range

S4-B: Position where plate is properly aligned

Process Steps: the process steps include, as follows:

Input job data into the Plate Mounting Machine computer system (not shown). This can be either:

a. Manual data entry of the various parameters (such as plate cylinder size), or b. Electronic referencing a database, perhaps by a scanning barcode(s), manual inputting a reference number, etc.

Loading the Cylinder:

c. Plate Mounting Machine 110 is in the "Load Cylinder" state: V-Block assembly 112 down, Table 101 up, left side clamp is rotated to a predetermined position, plate clamp "off", plate clamp is centered, Table Extension not attached to the machine;

d. Place the Plate Cylinder (PC) 22 on V-block lift assembly 112 (FIG. 23);

e. PC 22 is moved vertically to a precise loading position by the mechanism supporting and controlling the upward and downward movement of the V-block assembly 112 (S3);

f. PC Clamp, manual or powered (e.g. pneumatic or electric to step or motor 49) is activated precisely positioning the PC in the PMM. This clamp can hold the cylinder in several possible ways: tapered centers (similar to a lathe), stub shaft precisely fitting into inner race of the cylinder bearings, on journals of plate cylinders so equipped, etc.;

g. The plate cylinder 22 is manually or power rotated such that the PC cutting groove, not shown, is in the proper position. The groove assures that when a cutting blade, such as a razor blade, is used to trim the stickyback 24, it is pressed into the groove thus preventing damage to or scoring of other areas of the plate cylinder surface. For example, the machine could utilize a spring loaded plunger on the PC clamp mechanism which engages a hole in the end of the plate cylinder that is located at the correct angular displacement from the PC cutting groove.

Stickyback application.

h. An adequate amount of stickyback is unwound from the roll 47 and then the leading edge of the stickyback is manually attached to the plate cylinder 22. Placement of the edge is such that it overlaps the plate cylinder cutting groove (say by ½ to 2 inch). During this step, the unwind brake 51 of the stickyback roll 49 is tensioned so that the operator can assure a wrinkle free attachment.

i. The unwind brake tension of the stickyback roll is changed to an appropriate value and the plate cylinder 22 begins to turn wrapping stickyback onto the PC 22 under controlled tension. This rotation continues until the PC 22 cutting groove is properly located such that when the Table 101 is lowered, the straight edge is aligned with the PC groove;

j. Stickyback unwind tension is increased to prevent continued unwinding from of stickyback;

k. The Table 101 is lowered until the straight edge is close (say 1/64 inch) from the stickyback surface;

l. The operator trims the stickyback using a knife or razor blade which goes into the groove;

m. The Table 101 rises;

n. The operator removes the trimmed piece of stickyback;

o. The Stickyback unwind tension is lowered to the appropriate controlled level;

p. The plate cylinder 22 is turned by S2 and stickyback is smoothly laid onto the PC. S2 continues to turn the plate cylinder until it is in the appropriate position for the straight edge to be lined up with the groove.

q. The table 101 lowers;

r. The operator cuts the trailing edge, leaving a very small gap (less than 1/32 inch) with no overlap bump;

s. The operator rewinds the extended stickyback onto the roll 47;

t. The table 101 rises;

u. Operator removes stickyback liner; and v. Table 101 lowers.

Plate Alignment process a. Attach Table Extension 103 to Table 101 and secure with thumbscrews.

Back Clamp 102 up; Front Clamp 106 up and centered; tension brush 104 up Place Plate 10 under clamps 102/106 and tension brush 104

Roughly align plate 10; Machine Vision cameras 45 and system could indicate when in acceptable range, or a visual target such as a reticle or focused light spot could be used Back Clamp 102 down Machine Vision system 45 and S4 align plate (alignment is when imaginary line connecting the registration marks is parallel to the Printing Cylinder axis)

Plate attachment to Plate Cylinder. This section describes two of the most important improvements over existing technology: a) after alignment, the plate 10 is firmly constrained flat between the front and back clamps 102/106 preventing mis-alignment during the attachment stage. Then the table 101 lowers to a position such that a there is a band contact and adhesion of the plate 10 to the stickyback 24. In current machines, this stage requires the technician to manually attach the plate 10 to the stickyback 24 which could introduce skew that is propagated as the plate 10 is subsequently wrapped onto the cylinder; and b) in this invention, when the plate is wrapped onto the cylinder, it is done so under constant and non-skewing tension. Current methods have the operator holding the loose edge in one hand while turning the plate cylinder with the other hand to wrap the plate onto the cylinder. Usually the operator wipes the plate by hand onto the cylinder introducing skew and un-even tension. The sequence of steps is as follows:

Front Clamp-down; Tension Brush down. Table lowers to lightly touch the plate onto plate cylinder stickyback surface to achieve a band of ¼ inch or so of adhesion:

Release front clamp 106, remove table extension 103, and carefully lay the short extended plate edge (i.e. the leading edge 16) onto the stickyback;

Plate cylinder advances to draw plate onto stickyback. Tension brush maintains constant and non-skewing tension;

Wrapping continues; table has to rise in last inch or so to prevent interference between plate and straightedge;

Table lifts; and

Operator smooth's last attached edge.

Certification

Plate cylinder is rotated to certification position and table is moved to S1-H; Measurement and Certification position;

Machine vision measures errors;

Algorithm and operator determines if error is acceptable;

Proper reporting is accomplished; and

Each user company should have agreed procedures to handle situations where errors exceed established standards.

A feature of this invention is the satisfaction of a long felt need for improved plate mounting accuracy and the need for measuring, certifying, and reporting plate mounting accuracy.

Periodic Calibration of the Equipment

Mount an appropriate calibration device onto the machine 107. Such a device could be a cylinder of the average size used by the PMM that has visual targets on the surface, a line thru them being parallel to the axis of the cylinder;

Adjust and lock the camera's focus and aperture settings;

Align the cameras: This can be done mechanically or by software in the machine vision system.

Error in Flexographic Plate Mounting. Two of the biggest sources of error in current flexographic plate mounting are: maintaining equal distance across the gap for all plates; and skew. Skew is introduced because the operators must manually apply the plates to cylinders and introduce varying tensions and skew forces. The degree of control required to be accurate is beyond human capability. Skew is addressed in this invention by controlling the plate application tension with a method that does not introduce skew.

Maintaining proper space across the gap in the plate 10 involves elimination of skew and tension variation of plate application, plus several other elements. Plates are accurately made and reasonably rigid and plate cylinders are machined metal that can be held to close tolerances. There are several reasons why there error when the plate is snugly wrapped onto the cylinder. First there is the mathematics of the problem. If the plate is not stretched, the circumference of the surface upon which it is wrapped controls the distance of images across the gap. The shorter the circumference, the smaller is the distance across the gap. Circumference=$\pi\times$ Diameter. So a 0.001 inch diameter variation causes ~0.003 inch gap change. So, diameter and taper control of all the cylinders and the stickyback thickness (which lays on top of the cylinder) is very important.

Stickyback is an adhesive coated foam material, usually 0.015 or 0.020 inch thick. Foam is difficult material to precisely manufacture. And since the diameter is affected by twice the thickness of the foam, a 0.001 variation in foam thickness results in ~0.006 inch gap change. In plate mounting, one can reduce the applied thickness of the stickyback on the plate cylinder two ways: a) by increasing the tension by which the stickyback is applied; and b) by increasing the tension by which the plate is applied. Although flexographic plates are reasonably rigid, they do stretch with tension. One must have to contend with: Plate cylinder diameter, stickyback thickness as manufactured, stickyback thickness as it is affected when wrapped on the cylinder, stickyback thickness when it is compressed by plate application pressure, and plate stretch.

When you combine these factors with a generally accepted registration tolerance for printing a close register job of +/−0.003 inch which includes any registration variation caused on the press, one can see that this is a significant problem. Plate mounting cannot correct problems with press registration, plate cylinder diameter, or variation in stickyback thickness, but it can do its best to eliminate problems with tension variation in applying the stickyback and when applying the plates to the stickyback, thereby increasing the latitude for other elements of the process.

The present invention also incorporates a measurement of the final mounted plate. If the plates are mounted out of specification, a decision has to be made: Should the plates be remounted using techniques to correct the issues? or, perhaps the out of spec plate may have a less critical tolerance because of the nature of the graphics and it can go to press without harm. Is the plate cylinder out of spec? Is the stickyback out of spec as manufactured? Either of these can be taken up with the vendor. In any event, the precision of this method takes plate mounting out of the picture and the measurement/certification feature allows the user to avoid going to press with defectively mounted plates.

It is important to note that the present invention is not intended to be limited to a system or method which must satisfy one or more of any stated objects or features of the invention. It is also important to note that the present invention is not limited to the preferred, exemplary, or primary embodiment(s) described herein. Modifications and substitutions by one of ordinary skill in the art are considered to be within the scope of the present invention, which is not to be limited except by any allowed claims and their legal equivalents.

What is claimed is:

1. A method for accurately first aligning and then subsequently attaching a generally flat, planar object onto a drum or cylinder, such as a printing plate cylinder of a printing press, the method comprising:

providing a generally flat, planar object having a first end and a second end, the generally flat, planar object having at least a first and second registration mark, the at least a first registration mark located proximate the first end of the generally flat, planar object and the at least a second registration mark located proximate the second end of the generally flat, planar object;

providing a printing plate cylinder;

providing a double-sided adhesive member, at least one side of said double-sided adhesive member being covered by a release layer, said double-sided adhesive member sized to cover at least a portion of an exterior surface of said printing plate;

adhering a first side of said double-sided adhesive member to at least a portion of said exterior surface of said printing plate cylinder utilizing controlled tension and controlled alignment such that an exposed top surface of said double-sided adhesive member not adhered to said exterior surface of said printing plate cylinder is covered by said release layer;

removing an axial strip of said release layer on said top surface of said double-sided adhesive member adhered to said exterior surface of said printing plate cylinder exposing an axial strip of adhesive material;

covering at least a portion of said removed axial strip of adhesive material with a release material, said release material folded in two segments, a first segment having a length which is longer than said second segment, said first segment configured to extend beyond an end region of said double-sided adhesive member;

placing said generally flat planar object onto an alignment device, said alignment device including a mechanism for holding the first and second ends of said generally flat planar object in relationship to one another and for allowing said first and second ends of said generally flat planar object to be aligned relative to one another in a generally circular and/or oval form utilizing said at least first and second registration marks;

placing a piece of adhesive material across the aligned first and second ends of said generally flat plane or object, said piece of adhesive material configured for maintaining alignment of said first and second ends;

removing said aligned generally circular and/or oval previously generally flat planar object from said alignment device;

sliding said aligned generally circular and/or oval previously generally flat planar object onto said printing plate cylinder previously covered by said double-sided adhesive material;

removing said release material previously covering said removed axial strip of adhesive material by pulling on said first segment, said act of removing said release material exposing said axial strip of adhesive material;

adhering said aligned generally circular and/or oval previously generally flat planar object onto said exposed axial strip of adhesive material;

removing said piece of adhesive material across the aligned first and second ends of said generally circular and/or oval previously generally flat plane or object;

removing any remaining release layer on said top surface of said double-sided adhesive member adhered to said exterior surface of said printing plate cylinder exposing a top adhesive member adhesive surface; and adhering said previously generally flat planar object onto said exposed top adhesive member surface utilizing controlled tension and controlled alignment utilizing controlled tension and controlled alignment.

2. The method of claim 1, wherein said generally flat planar object includes an imaged printing plate.

3. The method of claim 1, wherein said generally flat planar object includes 4 registration marks, first and second registration marks located proximate the first end of the generally flat, planar object and third and fourth registration marks located proximate the second end of the generally flat, planar object, wherein said 4 registration marks form a virtual rectangular registration target.

4. The method of claim 1, wherein said registration marks are selected from the group consisting of a freestanding registration mark, a registration mark that is part of an image, a number, a graphic, a letter or other indicia, and a registration mark located in a bearer.

5. The method of claim 1, further including, after the act of adhering said previously generally flat planar object onto said exposed top adhesive member surface, the act of verifying, measuring and documenting the alignment of said aligned and adhered generally flat planar object onto said printing plate cylinder and storing data representing said verified, measured and documented alignment.

6. The method of claim 5, wherein said generally flat planar object includes plate identification information, and wherein said act of verifying, measuring and documenting the alignment of said aligned and adhere generally flat planar object onto said printing plate cylinder includes storing data representing said plate identification information.

7. The method of claim 6, wherein said plate identification information is selected from the group of plate identification information consisting of plate number and job number.

8. The method of claim 1, wherein said generally flat planar object includes four corners, and wherein said at least 2 registration marks includes four registration marks, one registration mark proximate each of said four corners of said generally flat planar object.

9. The method of claim 8, wherein said registration marks include a two dimensional registration mark.

10. The method of claim 9, wherein each said two dimensional registration mark includes indicia for facilitating alignment of said generally flat planar object.

11. The method of claim 10, wherein said indicia is selected from the group consisting of a dot and a crosshair mark.

12. The method of claim 1, wherein said at least one registration mark includes a three-dimensional registration mark.

13. The method of claim 12, wherein said at least one three dimensional registration mark includes a top region having indicia for facilitating alignment of said generally flat planar object.

14. The method of claim 1 wherein said step of placing said generally flat planar object onto an alignment device includes utilizing an alignment device including one or more vision cameras coupled to a machine vision management system, said one or more vision cameras coupled to said machine vision management system configured for allowing said first and second ends of said generally flat planar object to be manually or automatically aligned relative to one another in a generally circular and/or oval form utilizing said at least first and second registration marks, and further including after said first and second ends of said generally flat planar object are aligned relative to one another in a generally circular and/or oval form, recording by said machine vision management system details of said alignment in connection with an identification of said generally flat planar object, and storing said details of said alignment and said identification of said generally flat planar object.

15. The method of claim 14, wherein said one or more vision cameras coupled to said machine vision management system is configured for providing an indication to a machine vision system operator performing a current alignment of said first and second ends of said generally flat planar object into said generally circular and/or oval form whether said first and second ends of said generally flat planar object currently being aligned are aligned relative to one another in a generally circular and/or oval form, and for providing an indication to said operator of how and in what direction said first and second ends should be moved to bring them into alignment, and for storing data representing details of said alignment.

16. The method of claim 14, wherein said alignment device including one or more vision cameras coupled to said machine vision management system is configured for allowing said first and second ends of said generally flat planar object to be aligned by comparing the alignment of said plurality of registration marks on a current generally flat planar object to actual alignment data from one or more previously aligned generally flat planar objects.

17. The method of claim 14, wherein said alignment device including one or more vision cameras coupled to said machine vision management system is configured for allowing said first and second ends of said generally flat planar object to be aligned by comparing the alignment of said plurality of registration marks on a current generally flat planar object to alignment data from a virtual reference target alignment.

18. The method of claim 1, wherein said controlled tension applied in said the step of adhering a first side of said double-sided adhesive member to at least a portion of said exterior surface of said printing plate cylinder utilizing controlled tension and controlled alignment includes applying constant tension as said double-sided adhesive member is adhered to at least a portion of said exterior surface of said printing plate cylinder.

* * * * *